US008311464B2

(12) United States Patent
Kawase et al.

(10) Patent No.: US 8,311,464 B2
(45) Date of Patent: Nov. 13, 2012

(54) IMAGE FORMING APPARATUS, IMAGE FORMING METHOD, AND COMPUTER PROGRAM PRODUCT

(75) Inventors: Natsuko Kawase, Kanagawa (JP); Nobuyuki Kobayashi, Kanagawa (JP); Shigeyuki Ishii, Kanagawa (JP); Jun Kosako, Kanagawa (JP); Takahiro Kamekura, Kanagawa (JP); Takahiro Miyakawa, Kanagawa (JP); Takashi Enami, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 240 days.

(21) Appl. No.: 12/829,963

(22) Filed: Jul. 2, 2010

(65) Prior Publication Data

US 2011/0013949 A1 Jan. 20, 2011

(30) Foreign Application Priority Data

Jul. 17, 2009 (JP) ..... 2009-168504

(51) Int. Cl.

| | |
|---|---|
| ***G03G 15/01*** | (2006.01) |
| ***G03G 15/20*** | (2006.01) |
| ***G03G 15/16*** | (2006.01) |
| ***G03G 15/00*** | (2006.01) |

(52) U.S. Cl. ..... 399/301; 399/49; 399/72; 399/302; 399/303; 399/308; 399/317; 399/394

(58) Field of Classification Search ..... 399/49, 399/72, 301, 302, 303, 308, 317, 394
See application file for complete search history.

(56) References Cited

U.S. PATENT DOCUMENTS

| | | | | |
|---|---|---|---|---|
| 7,941,082 | B2 * | 5/2011 | Kosako et al. | 399/301 |
| 2007/0242971 | A1 * | 10/2007 | Goto | 399/82 |
| 2009/0022525 | A1 * | 1/2009 | Martin et al. | 399/298 |
| 2009/0073247 | A1 | 3/2009 | Kaneko et al. | |
| 2010/0302569 | A1 * | 12/2010 | Enami et al. | 358/1.12 |
| 2010/0303512 | A1 * | 12/2010 | Kamekura et al. | 399/301 |

FOREIGN PATENT DOCUMENTS

| | | |
|---|---|---|
| JP | 2003-263000 | 9/2003 |
| JP | 2005-215459 | 8/2005 |

OTHER PUBLICATIONS

U.S. Appl. No. 12/708,901, filed Feb. 19, 2010, Kosako, et al.
U.S. Appl. No. 12/780,346, filed May 14, 2010, Kamekura, et al.
U.S. Appl. No. 12/787,678, filed May 26, 2010, Enami, et al.

* cited by examiner

*Primary Examiner* — Joseph S Wong
(74) *Attorney, Agent, or Firm* — Oblon, Spivak, McClelland, Maier & Neustadt, L.L.P.

(57) ABSTRACT

An image forming apparatus includes a direct transfer control unit that controls a direct transfer unit and a first image forming unit so as to directly transfer an image onto a transfer sheet, an indirect transfer control unit that controls an intermediate transfer unit and a second image forming unit so as to transfer images onto the intermediate transfer unit, a secondary transfer control unit that controls contact/separation between the direct transfer unit and the intermediate transfer unit, a first alignment control unit that corrects an amount of misalignment among the images formed on the intermediate transfer unit, thereby performing a first alignment control process, and a second alignment control unit that corrects an amount of misalignment of an image directly transferred onto the transfer sheet with respect to the image on which the first alignment control process has been performed, thereby performing a second alignment control process.

10 Claims, 14 Drawing Sheets

FIG. 8

| | |
|---|---|
| PRINT MODE | FULL COLOR |
| K PHOTOSENSITIVE ELEMENT | PRINT |
| M PHOTOSENSITIVE ELEMENT | PRINT |
| C PHOTOSENSITIVE ELEMENT | PRINT |
| Y PHOTOSENSITIVE ELEMENT | PRINT |
| SECONDARY TRANSFER ROLLER | CONTACT |

FIG. 9

| | |
|---|---|
| PRINT MODE | BLACK-AND-WHITE |
| K PHOTOSENSITIVE ELEMENT | PRINT |
| M PHOTOSENSITIVE ELEMENT | STOP |
| C PHOTOSENSITIVE ELEMENT | STOP |
| Y PHOTOSENSITIVE ELEMENT | STOP |
| SECONDARY TRANSFER ROLLER | SEPARATION |

FIG. 10

| | |
|---|---|
| K PHOTOSENSITIVE ELEMENT | STOP |
| M PHOTOSENSITIVE ELEMENT | FIRST ALIGNMENT |
| C PHOTOSENSITIVE ELEMENT | FIRST ALIGNMENT |
| Y PHOTOSENSITIVE ELEMENT | FIRST ALIGNMENT |
| SECONDARY TRANSFER ROLLER | SEPARATION |

FIG. 11

| | |
|---|---|
| K PHOTOSENSITIVE ELEMENT | SECOND ALIGNMENT |
| M PHOTOSENSITIVE ELEMENT | RUN IDLE |
| C PHOTOSENSITIVE ELEMENT | SECOND ALIGNMENT |
| Y PHOTOSENSITIVE ELEMENT | RUN IDLE |
| SECONDARY TRANSFER ROLLER | CONTACT |

FIG. 12

| | |
|---|---|
| PRINT MODE | BLACK-AND-WHITE |
| K PHOTOSENSITIVE ELEMENT | PRINT |
| M PHOTOSENSITIVE ELEMENT | FIRST ALIGNMENT |
| C PHOTOSENSITIVE ELEMENT | FIRST ALIGNMENT |
| Y PHOTOSENSITIVE ELEMENT | FIRST ALIGNMENT |
| SECONDARY TRANSFER ROLLER | SEPARATION |

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2009-168504 filed in Japan on Jul. 17, 2009.

BACKGROUND OF THE INVENTION

1. Field of the Invention

The present invention relates to an image forming apparatus, an image forming method, and a computer program product.

2. Description of the Related Art

The technologies of an indirect transfer method and a direct transfer method are known as mechanisms for performing both black-and-white printing and full-color printing in an electrophotographic system. In the indirect transfer method, if black-and-white printing is performed, a black image is temporarily transferred onto an intermediate transfer unit and then the black image transferred onto the intermediate transfer unit is transferred onto a sheet. If full-color printing is performed, a full color image, which is formed by superimposing images in different colors, is transferred onto an intermediate transfer unit and then the full-color image transferred onto the intermediate transfer unit is transferred onto a sheet. In the direct transfer method, if black-and-white printing is performed, a black image is directly transferred onto a sheet. If full-color printing is performed, an image in each color is directly transferred onto a sheet.

If color matching (alignment) among images in different colors that are transferred onto a sheet by an indirect transfer method is performed, the images in the different colors are temporarily transferred onto an intermediate transfer unit and alignment control is performed by reading the images in the different colors that are transferred onto the intermediate transfer unit. On the other hand, it is generally known that, if color matching (alignment) among images that are transferred onto a sheet by a direct transfer method is performed, the images are transferred onto a sheet and alignment control is performed by reading the images transferred onto the sheet.

The alignment controls in the indirect transfer method and the direct transfer method are performed by feedback control in which the images transferred onto the intermediate transfer unit or the sheet are read; therefore, there is a problem in that, if the alignment control is performed in an image forming apparatus (see Japanese Patent Application Laid-open No. 2005-215459) that uses two transfer methods, i.e., an indirect transfer method and a direct transfer method, in combination, it is complicated and difficult to perform alignment between an image formed by the indirect transfer method and an image formed by the direct transfer method because the transfer targets are different in the indirect transfer method and the direct transfer method.

SUMMARY OF THE INVENTION

It is an object of the present invention to at least partially solve the problems in the conventional technology.

According to one aspect of the present invention, an image forming apparatus includes: a direct transfer control unit that controls a first image forming unit that forms an image in a single color or a plurality of colors and controls a direct transfer unit so as to directly transfer the image in the single color or the plurality of colors onto a transfer sheet that is conveyed by the direct transfer unit; an indirect transfer control unit that controls a second image forming unit that forms images in a plurality of colors except for the color of the image formed by the first image forming unit and controls an intermediate transfer unit so as to transfer the images in the plurality of colors onto the intermediate transfer unit; a secondary transfer control unit that controls contact and separation between the direct transfer unit and the intermediate transfer unit; a first alignment control unit that causes the secondary transfer control unit to perform a separation control and corrects an amount of misalignment among the images in the plurality of colors formed on the intermediate transfer unit, thereby performing a first alignment control process; and a second alignment control unit that causes the secondary transfer control unit to perform a contact control, transfers, onto the transfer sheet, an image in at least one color formed on the intermediate transfer unit, the first alignment control process having been performed on the image, and corrects an amount of misalignment of an image that is directly transferred onto the transfer sheet with respect to the image on which the first alignment control process has been performed, thereby performing a second alignment control process.

According to another aspect of the present invention, an image forming method performed by an image forming apparatus including a control unit and a storage unit, the image forming method includes: causing, by the control unit, a direct transfer control unit to control a first image forming unit that forms an image in a single color or a plurality of colors and to control a direct transfer unit so as to directly transfer the image in the single color or the plurality of colors onto a transfer sheet that is conveyed by the direct transfer unit; causing, by the control unit, an indirect transfer control unit to control a second image forming unit that forms images in a plurality of colors except for the color of the image formed by the first image forming unit and to control an intermediate transfer unit so as to transfer the images in the plurality of colors onto the intermediate transfer unit; causing, by the control unit, a secondary transfer control unit to control contact and separation between the direct transfer unit and the intermediate transfer unit; causing, by the control unit, a first alignment control unit to cause the secondary transfer control unit to perform a separation control and to detect an amount of misalignment among the images in the plurality of colors formed on the intermediate transfer unit so as to correct the amount of misalignment, thereby performing a first alignment control process; and causing, by the control unit, a second alignment control unit to cause the secondary transfer control unit to perform a contact control, and to transfer, onto the transfer sheet, an image in at least one color formed on the intermediate transfer unit, the first alignment control process having been performed on the image, and correct an amount of misalignment of an image that is directly transferred onto the transfer sheet with respect to a position of the image on which the first alignment control process has been performed, thereby performing a second alignment control process.

According to still another aspect of the present invention, a computer program product includes a computer-readable medium having computer-readable program codes embodied in the medium. When executed by a computer, the program codes causes the computer to perform: controlling a first image forming unit that forms an image in a single color or a plurality of colors and controlling a direct transfer unit so as to directly transfer the image in the single color or the plurality of colors onto a transfer sheet that is conveyed by the direct transfer unit; controlling a second image forming unit that forms images in a plurality of colors except for the color of the image formed by the first image forming unit and controlling an intermediate transfer unit so as to transfer the images in the plurality of colors onto the intermediate transfer unit; controlling contact and separation between the direct transfer unit and the intermediate transfer unit; controlling to separate the direct transfer unit and the intermediate transfer unit, and detecting and correcting an amount of misalignment among the images in the plurality of colors formed on the intermediate transfer unit, thereby performing a first alignment control process; and controlling to contact the direct transfer unit with the intermediate transfer unit, transferring, onto the transfer sheet, an image in at least one color formed on the intermediate transfer unit, the first alignment control process having been performed on the image, and correcting an amount of misalignment of an image that is directly transferred onto the transfer sheet with respect to the image on which the first alignment control process has been performed, thereby performing a second alignment control process.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a diagram that illustrates the operations of each photosensitive element and a secondary transfer roller during full-color printing according to the first embodiment;

FIG. 9 is a diagram that illustrates the operations of each photosensitive element and the secondary transfer roller during black-and-white printing according to the first embodiment;

FIG. 10 is a diagram that illustrates the operations of each photosensitive element and the secondary transfer roller during the first alignment control process according to the first embodiment;

FIG. 11 is a diagram that illustrates the operations of each photosensitive element and the secondary transfer roller during the second alignment control process according to the first embodiment;

FIG. 12 is a diagram that illustrates the operations of each photosensitive element and the secondary transfer roller if the first alignment control process is performed at the same time as black-and-white printing according to the first embodiment;

DETAILED DESCRIPTION OF THE PREFERRED EMBODIMENTS

Embodiments of an image forming apparatus, an image forming method, and a computer program product according to the present invention are explained in detail below with reference to the accompanying drawings.

An explanation is given of a first embodiment of the present invention with reference to FIGS. 1 to 13. In the embodiment according to the present embodiment, what is called a Multi Function Peripheral (MFP), which has, in combination, a copy function, a facsimile (FAX) function, a print function, a scanner function, a function for distributing an input image (an image of an original read using a scanner function or an image input using a printer or FAX function), and the like, is used as an image forming apparatus.

Figure 1:
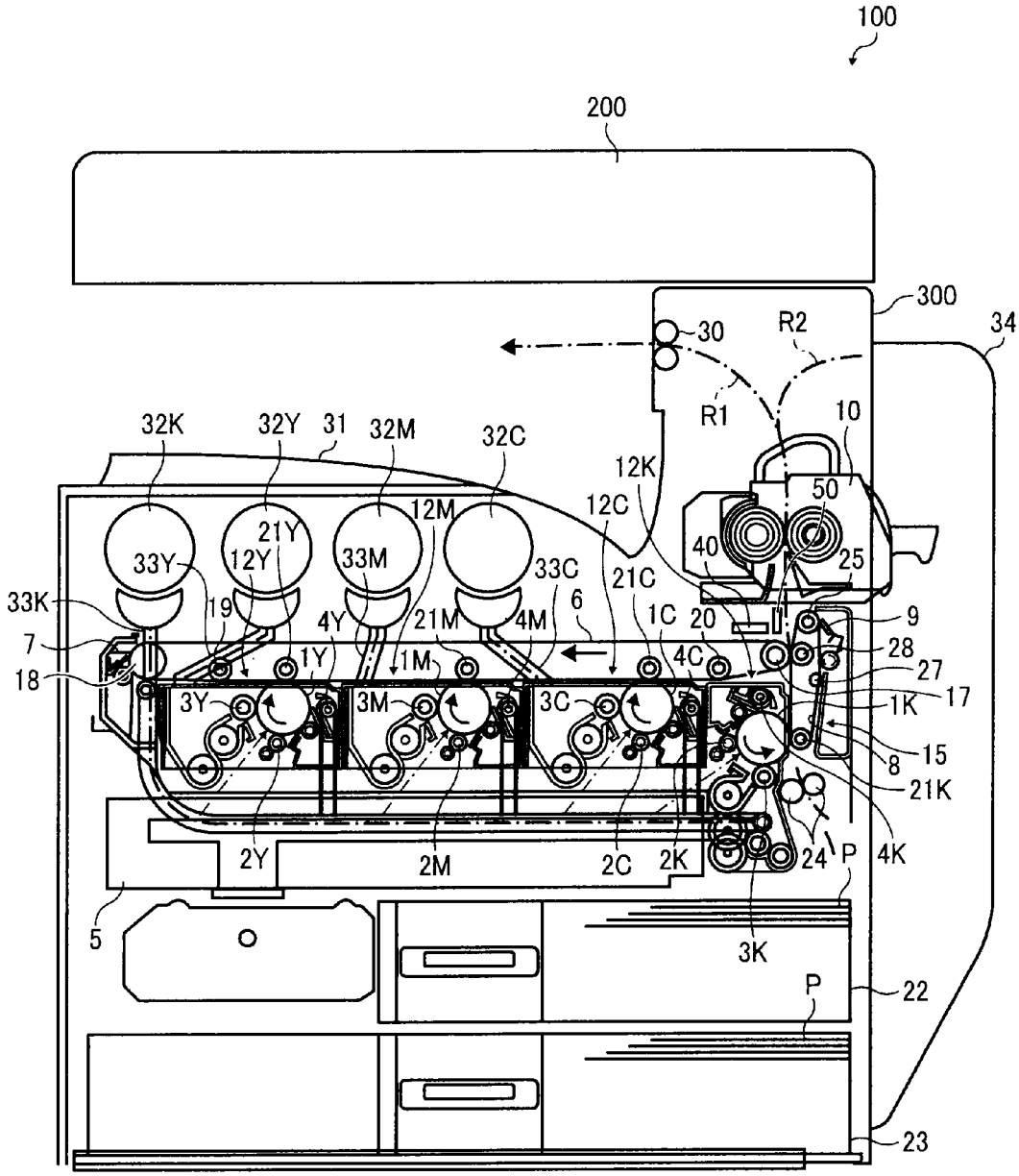
FIG. 1 is a schematic diagram of a Multi Function Peripheral according to a first embodiment.

FIG. 1 is a schematic diagram of an MFP 100 according to the first embodiment. As illustrated in FIG. 1, the MFP 100 is made up of a scanner unit 200 that is an image reading apparatus and a printer unit 300 that is an image printing apparatus that has an electrophotographic system. An engine control unit 500 (see FIG. 3) is made up of the scanner unit 200 and the printer unit 300. In the MFP 100 according to the present embodiment, a document box function, a copy function, a printer function, and a facsimile function can be sequentially selected by using an application switch key of an operation input unit 400 (see FIG. 3). The document box mode is set when the document box function is selected, the copy mode is set when the copy function is selected, the printer mode is set when the printer function is selected, and the facsimile mode is set when the facsimile function is selected.

A detailed explanation is given of the printer unit 300 that has the characteristic functions of the MFP 100 according to the first embodiment. As illustrated in FIG. 1, the printer unit 300 in the MFP 100 has a tandem system in which three image forming units 12Y, 12M, and 12C for yellow (Y), magenta (M), and cyan (C) (a second image forming unit that forms images in a plurality of colors except for the color of the image formed by an image forming unit 12K, which is explained later) are serially arranged in the belt-moving direction along an intermediate transfer belt 6 that is a looped intermediate transfer unit extending substantially horizontally. The intermediate transfer belt 6 is supported by a drive roller 17, a follower roller 18, and tension rollers 19 and 20. A cleaning unit 7 that removes residual toner from the intermediate transfer belt 6 is located on the outer side of the intermediate transfer belt 6 and is opposed to the follower roller 18.

In addition, in the printer unit 300 of the MFP 100, the image forming unit 12K for black (K) is separately arranged at an upstream position of the tandem arrangement in the moving direction of a transfer sheet (recording medium). The image forming unit 12K for black (K) (a first image forming unit that forms an image in a single color or a plurality of colors) is arranged such that a toner image formed by the image forming unit 12K for black is directly transferred onto a transfer sheet. More specifically, the image forming unit 12K for black is separate from the transfer structures for colors Y, M, and C that are opposed to the intermediate transfer belt 6, and a black toner image formed thereby is directly transferred onto a transfer sheet P that is conveyed by a transfer-sheet conveying belt 8 (a direct transfer unit) that is different from the intermediate transfer belt 6. A secondary transfer unit 15 is arranged such that it substantially vertically intersects with the intermediate transfer belt 6 extending substantially horizontally and is located at a position on the conveying path of the transfer sheet P, on which a plurality of color images superimposed on the intermediate transfer belt 6 and a black image transferred onto the transfer sheet P are superimposed. More specifically, the image forming unit 12K for black is located near and along the substantially vertical conveying path of the transfer sheet P, and the secondary transfer unit 15 is located in a space on the upstream side of a fixing device 10 on the substantially vertical conveying path.

Figure 2:
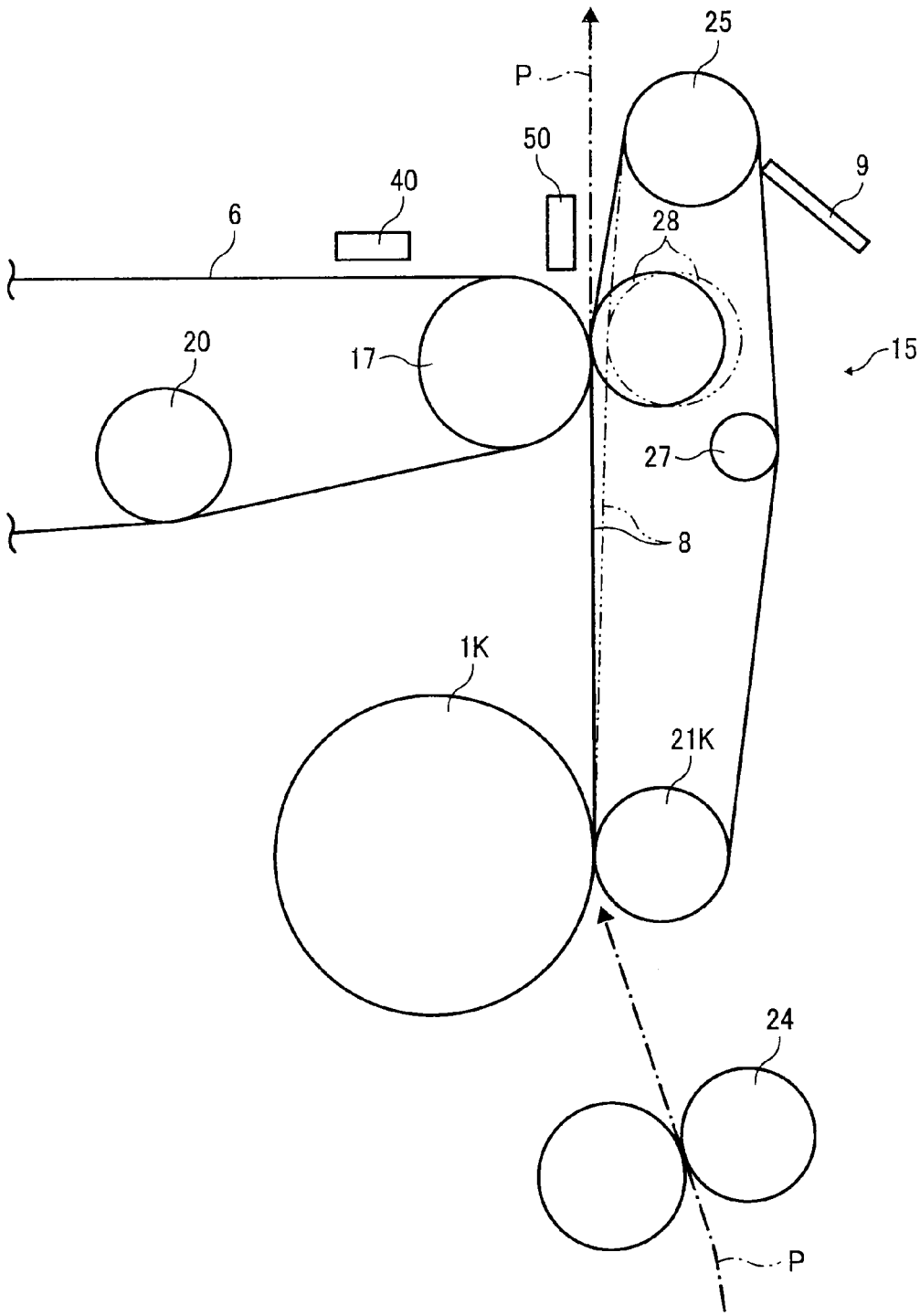
FIG. 2 is a diagram that schematically illustrates the configuration of a secondary transfer unit depicted in FIG. 1.

An explanation is given of the schematic configuration of the secondary transfer unit 15 with reference to FIG. 2. FIG. 2 is a diagram that schematically illustrates the configuration of the secondary transfer unit 15. As illustrated in FIG. 2, the secondary transfer unit 15 principally includes the transfer-sheet conveying belt 8, a drive roller 25 that supports the transfer-sheet conveying belt 8, a follower roller 21K that is also a transfer unit, a tension roller 27, a secondary transfer roller 28 that is a secondary transfer unit, and a cleaning device 9 that cleans the transfer-sheet conveying belt 8. The secondary transfer roller 28 is arranged such that it is opposed to the drive roller 17 of the intermediate transfer belt 6 and can be located close to or away from the intermediate transfer belt 6 while the tension of the transfer-sheet conveying belt 8 is retained by an undepicted contact/separate mechanism and the tension roller 27.

Although the secondary transfer unit 15 according to the first embodiment has a configuration to displace the secondary transfer roller 28, the present invention is not limited thereto and the entire transfer-sheet conveying belt 8 may be displaced by using the follower roller 21K as a supporting point.

A conventional configuration is known that locates an intermediate transfer belt away from image carriers for colors except black during formation of monochrome images. In this system, only the intermediate transfer belt is driven and image forming units for colors except black do not need to be driven (run idle); however, because the intermediate transfer belt is displaced, the problem of tension variation is inevitable. If a configuration is such that the secondary transfer roller 28 is displaced or the entire transfer-sheet conveying belt 8 is displaced, the transfer-sheet conveying belt 8, which has a circumferential length much shorter than that of the intermediate transfer belt 6, is moved in or away so that the intermediate transfer belt 6 can be left unchanged (does not move together with the transfer-sheet conveying belt 8); therefore, the tension of the intermediate transfer belt 6 does not vary. Specifically, a configuration can be such that the intermediate transfer belt 6, for which alignment needs to be performed at many points, is brought into contact with or separated from the transfer-sheet conveying belt 8; however, in this case, there is a possibility that the position accuracy for alignment is decreased over time. Conversely, according to the first embodiment, because a configuration can be such that the intermediate transfer belt 6 is kept in contact with respective photosensitive elements 1 (1Y, 1M, 1C) for colors Y, M, and C, high positioning accuracy can be set between the intermediate transfer belt 6 and the rollers, which improves the allowance for shifting of the belt. Furthermore, because the belt is moved in a stable manner, it is possible to improve the allowance for misalignment during formation of full-color images.

A configuration may be such that the drive roller 17, which supports the intermediate transfer belt 6, is displaced by an undepicted contact/separate mechanism, the tension of the intermediate transfer belt 6 is retained by the tension roller 20, and the intermediate transfer belt 6 is brought into contact with or separated from the transfer-sheet conveying belt 8. In this case, because the conveying position of the transfer sheet P does not change, the behavior of the transfer sheet P is stable between the transfer-sheet conveying belt 8 and the fixing device 10. Therefore, it is possible to prevent the occurrence of folds in or image distortion of the transfer sheet P discharged from the fixing device 10. Furthermore, a configuration may be such that both the secondary transfer roller 28 in the secondary transfer unit 15 and the drive roller 17, which supports the intermediate transfer belt 6, are moved so that the intermediate transfer belt 6 and the transfer-sheet conveying belt 8 are brought into contact with or separated from each other.

With reference back to FIG. 1, each of the image forming units 12Y, 12M, 12C, and 12K is configured as a process cartridge that is removable from the main body of the printer unit 300. The image forming unit 12 (12Y, 12M, 12C, 12K) includes the photosensitive element 1 (1Y, 1M, 1C, 1K) that is an image carrier, a charging device 2 (2Y, 2M, 2C, 2K), a developing device 3 (3Y, 3M, 3C, 3K) that feeds toner to a latent image to form a toner image, a cleaning device 4 (4Y, 4M, 4C, 4K), and the like. In the image forming units 12Y, 12M, and 12C, the photosensitive elements 1Y, 1M, and 1C are arranged such that they are in contact with the stretched surface of the lower side of the intermediate transfer belt 6. Primary transfer rollers 21Y, 21M, and 21C are arranged as primary transfer units on the inner side of the intermediate transfer belt 6 such that they are opposed to the photosensitive elements 1 (1Y, 1M, 1C).

The printer unit 300 in the MFP 100 includes an exposure device 5 that emits laser light from an undepicted LD and corresponds to the image forming unit 12 (12Y, 12M, 12C, 12K) for each color. An original read by the scanner unit 200, data received by a facsimile, or the like, or color image information transmitted from a computer is subjected to color separation for each of the colors yellow, cyan, magenta, and black so as to form data on a channel for each color, and the data is then sent to the exposure device 5 in the image forming unit 12 (12Y, 12M, 12C, 12K) for each color. The laser light emitted from the LD of the exposure device 5 forms an electrostatic latent image on the photosensitive element 1 (1Y, 1M, 1C, 1K) of the image forming unit 12 (12Y, 12M, 12C, 12K).

Although the blade-type cleaning devices 4 and 9 are used as described above, the present invention is not limited thereto, and a fur-brush roller or a magnetic-brush cleaning system may be used. The exposure device 5 is not limited to a laser system and may be an LED system, or the like.

As illustrated in FIGS. 1 and 2, the printer unit 300 further includes pattern detection sensors 40 that detect a first alignment control pattern 13 (see FIG. 6) in order to measure an amount of misalignment, such as an amount of skew which occurs in scanning of the undepicted LD. The pattern detection sensors 40 are located on the extreme left, the middle, and the extreme right of the intermediate transfer belt 6 in its width direction.

As illustrated in FIGS. 1 and 2, the printer unit 300 further includes a pattern detection sensor 50 that detects a second alignment control pattern 14 (see FIG. 7) in order to measure the amount of misalignment of an image in the color K with respect to the position of an image in at least any one of the colors Y, M, and C on the transfer sheet P. The pattern detection sensor 50 is located between the intermediate transfer belt 6 and the fixing device 10.

For example, reflective optical sensors (specularly-reflected light sensors) are used as the pattern detection sensors 40 and 50. In this case, the intermediate transfer belt 6 is irradiated with light so that the pattern detection sensor 40 detects light reflected by the intermediate transfer belt 6 and the first alignment control pattern 13 formed on the intermediate transfer belt 6 so as to obtain information for measuring the amount of misalignment. In the same manner, the transfer sheet P is irradiated with light so that the pattern detection sensor 50 detects light reflected by the transfer sheet P and the second alignment control pattern 14 formed on the transfer sheet P so as to obtain information (the intensity of the reflected light) for measuring the amount of misalignment.

Although the specularly-reflected light sensors are used as the pattern detection sensors 40 and 50, the present invention is not limited thereto, and a configuration may be such that a diffused-light sensor unit or a reflective photosensor, which can detect both output of specularly reflected light and output of diffused light, is used to read the light diffused by the first alignment control pattern 13 and the intermediate transfer belt 6 or the second alignment control pattern 14 and the transfer sheet P.

Feed trays 22 and 23 that contain transfer sheets of different sizes are located under the printer unit 300 of the MFP 100, and the transfer sheet P fed from each of the feed trays 22 and 23 by an undepicted feed unit is conveyed to a registration roller pair 24 by an undepicted conveying unit so that skew is corrected by the registration roller pair 24 and then the transfer sheet P is conveyed by the registration roller pair 24 to a transfer area between the photosensitive element 1K and the transfer-sheet conveying belt 8 at a predetermined timing.

The printer unit 300 in the MFP 100 further includes a toner bank 32 that is located above the intermediate transfer belt 6. The toner bank 32 is made up of toner tanks 32K, 32Y, 32M, and 32C, and these toner tanks are connected to the developing devices 3 (3Y, 3M, 3C, 3K) via toner feed pipes 33K, 33Y, 33M, and 33C. Because the image forming unit 12K for black is arranged separately from the image forming units 12 (12Y, 12M, 12C) for colors Y, M, and C, transfer toner for colors Y, M, and C does not get mixed during the process of forming black images. Therefore, toner collected from the photosensitive element 1K is conveyed to the developing device 3K for black via an undepicted black-toner collection path and is then reused. A device that removes paper dust or a device that can switch a path to dispose of toner may be located along the black-toner collection path.

Figure 3:
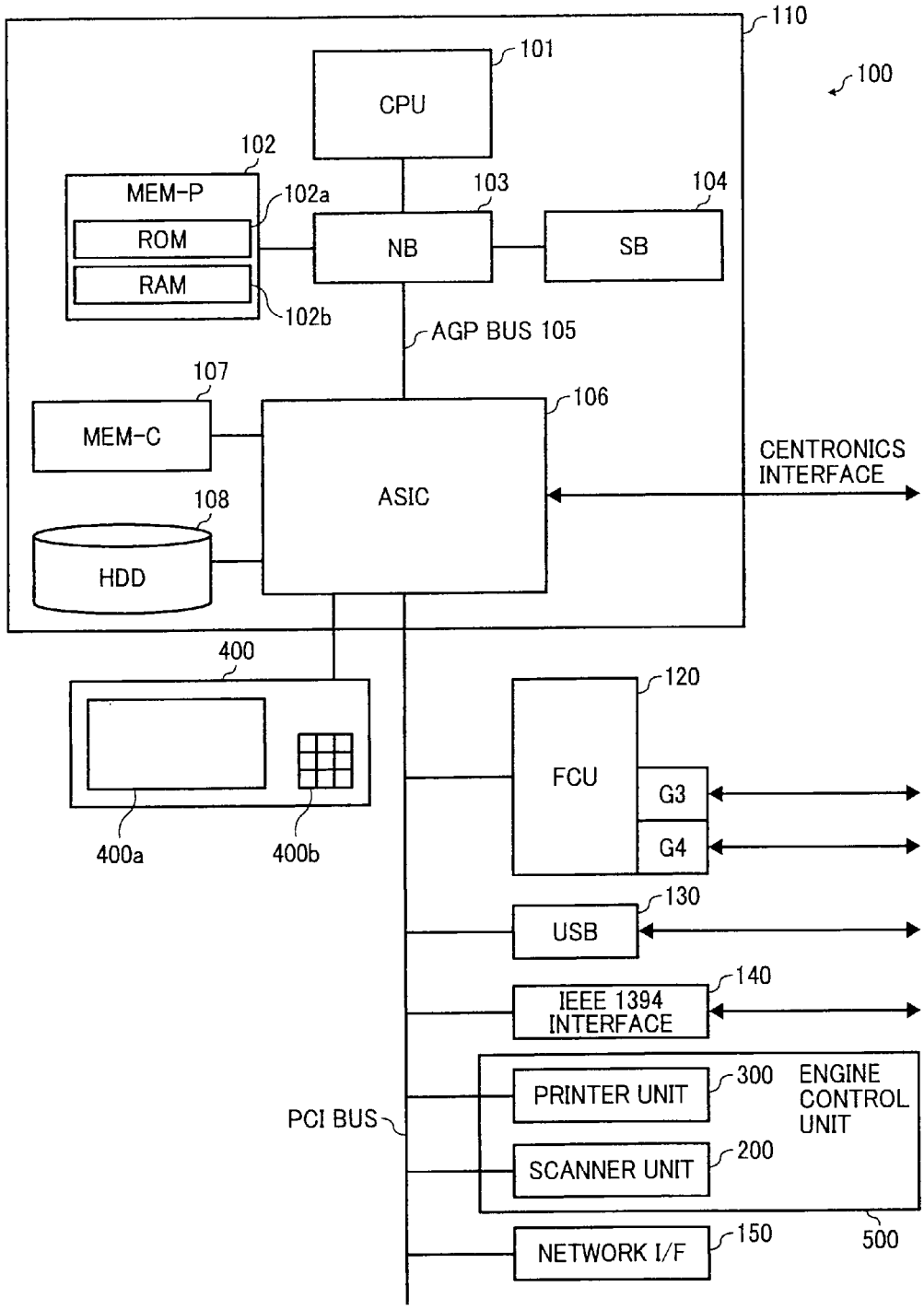
FIG. 3 is a block diagram that illustrates the hardware configuration of the MFP depicted in FIG. 1.

Next, an explanation is given of the hardware configuration of the MFP 100. FIG. 3 is a block diagram that illustrates the hardware configuration of the MFP 100. As illustrated in FIG. 3, the MFP 100 has a configuration such that a controller 110, the printer unit 300, and the scanner unit 200 are connected to one another via a Peripheral Component Interconnect (PCI) bus. The controller 110 is a controller that controls the entire MFP 100 and controls drawing, communication, and input from the operation input unit 400. The printer unit 300 or the scanner unit 200 includes an image processing section for error diffusion, gamma transformation, or the like. The operation input unit 400 includes an operation display unit 400*a* that displays, on a Liquid Crystal Display (LCD), original image information, or the like, on an original read by the scanner unit 200 and receives input from an operator via a touch panel and also includes a keyboard unit 400*b* that receives input keyed in by the operator.

The controller 110 includes a Central Processing Unit (CPU) 101 that is the main part of a computer, a system memory (MEM-P) 102, a north bridge (NB) 103, a south bridge (SB) 104, an Application Specific Integrated Circuit (ASIC) 106, a local memory (MEM-C) 107 that is a storage unit, and a hard disk drive (HDD) 108 that is a storage unit and has a configuration such that the NB 103 is connected to the ASIC 106 via an Accelerated Graphics Port (AGP) bus 105. The MEM-P 102 further includes a Read Only Memory (ROM) 102*a* and a Random Access Memory (RAM) 102*b*.

The CPU 101 performs overall control of the MFP 100 and includes a chip set made up of the NB 103, the MEM-P 102, and the SB 104 so that the CPU 101 is connected to other devices via the chip set.

The NB 103 is a bridge to connect the CPU 101, the MEM-P 102, the SB 104, and the AGP bus 105 and includes a memory controller that controls reading from and writing to the MEM-P 102, a PCI master, and an AGP target.

The MEM-P 102 is a system memory used as a memory for storing programs and data, a memory for loading programs and data, a memory for drawing by a printer, or the like, and includes the ROM 102*a* and the RAM 102*b*. The ROM 102*a* is a read-only memory used as a memory for storing data and programs for controlling operations of the CPU 101, and the RAM 102*b* is a writable and readable memory used as a memory for loading programs and data, a memory for drawing by a printer, or the like.

The SB 104 is a bridge to connect the NB 103, a PCI device, and a peripheral device. The SB 104 is connected to the NB 103 via the PCI bus, and a network interface (I/F) 150, or the like, is also connected to the PCI bus.

The ASIC 106 is an Integrated Circuit (IC) intended for image processing that includes a hardware element for image processing and has a function as a bridge to connect the AGP bus 105, the PCI bus, the HDD 108, and the MEM-C 107. The ASIC 106 is made up of a PCI target, an AGP master, an arbiter (ARB) that is the central core of the ASIC 106, a memory controller that controls the MEM-C 107, a plurality of Direct Memory Access Controllers (DMACs) that perform the rotation of image data, or the like, by using hardware logic, and a PCI unit that performs data transfer with the printer unit 300 or the scanner unit 200 via the PCI bus. A Fax Control Unit (FCU) 120, a Universal Serial Bus (USB) 130, an IEEE 1394 (the Institute of Electrical and Electronics Engineers 1394) interface 140 are connected to the ASIC 106 via the PCI bus.

The MEM-C 107 is a local memory used as a copy image buffer or a code buffer, and the HDD 108 is storage for storing image data, storing programs for controlling operations of the CPU 101, storing font data, and storing forms.

The AGP bus 105 is a bus interface for a graphics accelerator card proposed for speeding up graphics processes and directly accesses the MEM-P 102 at a high throughput so that the speed of the graphics accelerator card is increased.

A program to be executed by the MFP 100 according to the present embodiment is provided by being installed on a ROM, or the like, in advance. A configuration may be such that a program to be executed by the MFP 100 according to the first embodiment is provided by being stored, in the form of a file that is installable and executable, in a recording medium readable by a computer, such as a CD-ROM, a flexible disk (FD), a CD-R, or a Digital Versatile Disk (DVD). The recording medium may be included in a computer program product.

Furthermore, a configuration may be such that a program to be executed by the MFP 100 according to the present embodiment is stored in a computer connected via a network such as the Internet and provided by being downloaded via the network. Moreover, a configuration may be such that a program to be executed by the MFP 100 according to the first embodiment is provided or distributed via a network such as the Internet.

Figure 4:
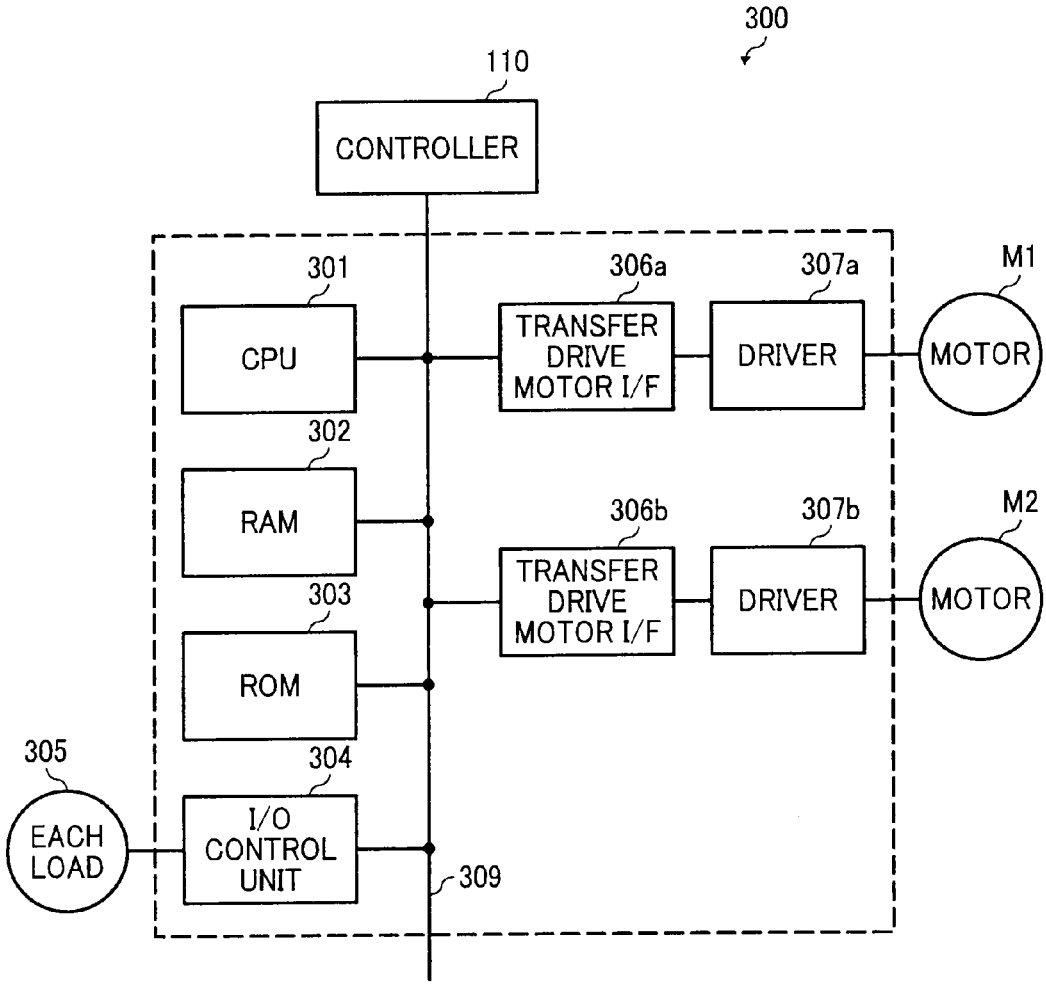
FIG. 4 is a block diagram that illustrates the hardware configuration of a printer unit depicted in FIG. 1.

FIG. 4 is a block diagram that illustrates the hardware configuration of the printer unit 300. As illustrated in FIG. 4, a control system of the printer unit 300 principally includes a CPU 301, a RAM 302, a ROM 303, an I/O control unit 304, a transfer drive motor I/F 306*a*, a driver 307*a*, a transfer drive motor I/F 306*b*, and a driver 307*b*.

The CPU 301 performs overall control of the printer unit 300, including the control of reception of image data input from the controller 110 and transmission and reception of control commands.

The RAM 302 used for working, the ROM 303 for storing programs, and the I/O control unit 304 are connected to one another via a bus 309 and, data read/write processes and various operations of a motor, clutch, solenoid, sensor, or the like, for driving various loads 305, such as a contact/separate mechanism, are executed in response to an instruction from the CPU 301.

In response to a drive command from the CPU 301, the transfer drive motor I/F 306*a* outputs a command signal to the driver 307*a* so as to give a command on the drive frequency of a drive pulse signal. A motor M1 is rotated in accordance with the frequency. The drive roller 17 illustrated in FIG. 2 is rotated in accordance with the rotation of the motor M1. Similarly, in response to a drive command from the CPU 301, the transfer drive motor I/F 306*b* outputs a command signal to the driver 307*b* so as to give a command on the drive frequency of a drive pulse signal. A motor M2 is rotated in accordance with the frequency. The drive roller 25 illustrated in FIG. 2 is rotated in accordance with the rotation of the motor M2.

The RAM 302 is used as a work area for executing programs stored in the ROM 303. Because the RAM 302 is a volatile memory, parameters, such as amplitude or phase values, to be used for a subsequent belt drive are stored in an undepicted nonvolatile memory such as an Electrically Erasable Programmable Read Only Memory (EEPROM), and data corresponding to one cycle of a belt is loaded into the RAM 302 by using a sine function or an approximate equation when the power is turned on or the drive roller 17 is driven.

A program executed by the printer unit 300 according to the first embodiment has a module configuration including each of the units described below (a print control unit 51, an alignment control unit 52, an indirect transfer control unit 53, a direct transfer control unit 54, a secondary transfer control unit 55, and the like (see FIG. 5)) and, as actual hardware, the CPU 301 reads a program from the ROM 303 and executes the read program so as to load each of the units described above into a main storage so that the print control unit 51, the alignment control unit 52, the indirect transfer control unit 53, the direct transfer control unit 54, the secondary transfer control unit 55, and the like are generated in the main storage.

Figure 5:
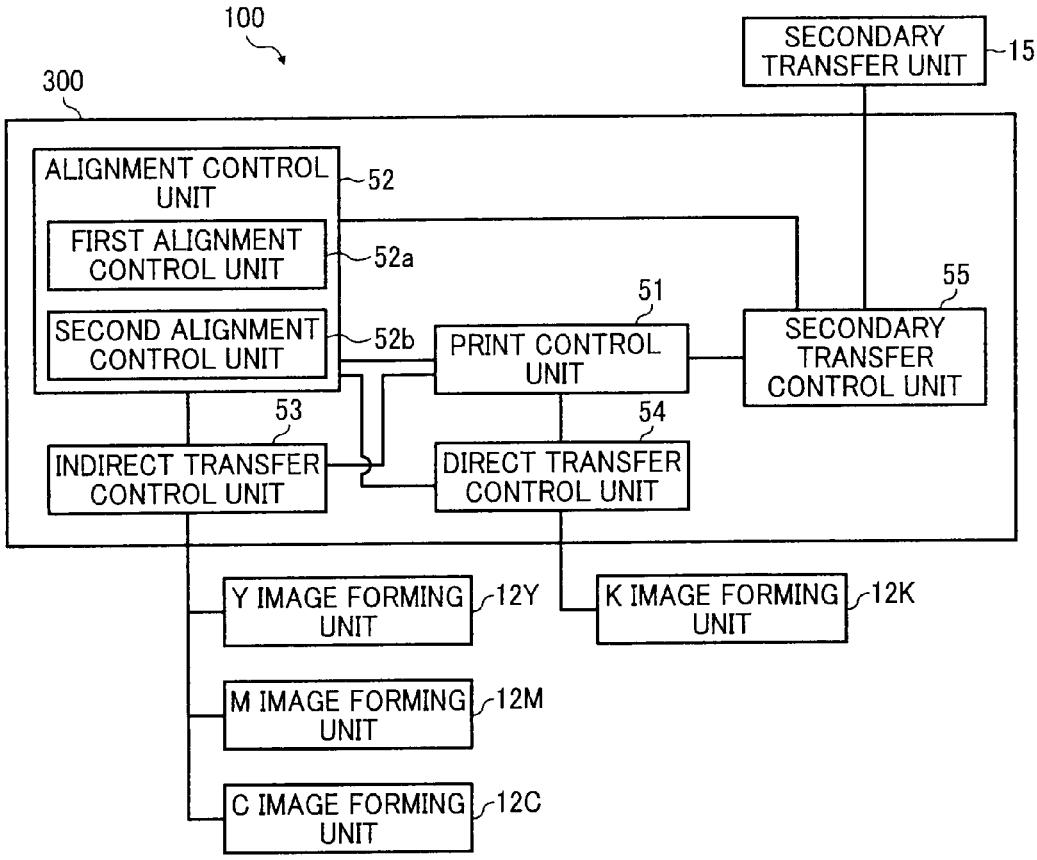
FIG. 5 is a block diagram that illustrates the functional configuration of the printer unit depicted in FIG. 1.

FIG. 5 is a block diagram that illustrates the functional configuration of the printer unit 300 according to the first embodiment. The printer unit 300 principally includes the print control unit 51, the alignment control unit 52, the indirect transfer control unit 53, the direct transfer control unit 54, and the secondary transfer control unit 55. The alignment control unit 52 includes a first alignment control unit 52*a* and a second alignment control unit 52*b*.

The print control unit 51 controls the entire system (the alignment control unit 52, the indirect transfer control unit 53, the direct transfer control unit 54, the secondary transfer control unit 55, and the like) in order to perform full-color printing, black-and-white printing, alignment control processes, and the like. The print control unit 51 receives an instruction as to whether the alignment control process is to be performed via the operation input unit 400. The print control unit 51 determines whether the first alignment control process has been finished by the first alignment control unit 52*a*, which is explained later, and, if it is determined that the first alignment control process has been finished, instructs the second alignment control unit 52*b*, which is explained later, to start the second alignment control process.

During full-color printing and black-and-white printing, the direct transfer control unit 54 controls the image forming unit 12K for color K and the transfer-sheet conveying belt 8 so as to directly transfer a toner image in color K onto the transfer sheet P. More specifically, under the control of the direct transfer control unit 54, a toner image in color K is formed on the photosensitive element 1K of the image forming unit 12K for color K, and the toner image in color K is transferred onto the transfer sheet P that is conveyed by the transfer-sheet conveying belt 8.

When the second alignment control process is performed by the second alignment control unit 52*b*, which is explained later, the direct transfer control unit 54 controls the image forming unit 12K for color K and the transfer-sheet conveying belt 8 so as to directly transfer, onto the transfer sheet P, the second alignment control pattern 14 (see FIG. 7) in color K as a toner image in color K.

During full-color printing, the indirect transfer control unit 53 controls the image forming units 12Y, 12M, and 12C for colors Y, M, and C and the intermediate transfer belt 6 so as to transfer images in colors Y, M, and C, which are to be transferred onto the transfer sheet P, onto the intermediate transfer belt 6. More specifically, under the control of the indirect transfer control unit 53, toner images in colors Y, M, and C formed on the photosensitive elements 1Y, 1M, and 1C of the image forming units 12Y, 12M, and 12C are superimposed on the intermediate transfer belt 6 by an indirect transfer method.

When the first alignment control process is performed by the first alignment control unit 52*a*, which is explained later, the indirect transfer control unit 53 controls the image forming units 12Y, 12M, and 12C and the intermediate transfer belt 6 so as to transfer the first alignment control pattern 13 (13Y, 13M, 13C) (see FIG. 6) onto the intermediate transfer belt 6. When the second alignment control process is performed by the second alignment control unit 52*b*, which is explained later, the indirect transfer control unit 53 controls the intermediate transfer belt 6 and the image forming unit 12C, which is located at the least downstream position in the conveying direction of the intermediate transfer belt 6, so as to transfer the second alignment control pattern 14 in color C (see FIG. 7) onto the intermediate transfer belt 6. Thus, the second alignment control pattern 14 in color C can be transferred onto the intermediate transfer belt 6 in the shortest time after the second alignment control pattern 14 in color K is transferred onto the transfer sheet P, whereby it is possible to shorten the time required for the second alignment control process.

According to the first embodiment, the indirect transfer control unit 53 transfers the second alignment control pattern 14 onto the intermediate transfer belt 6 by using the image forming unit 12C; however, the present invention is not limited thereto as long as the second alignment control pattern 14 is transferred onto the intermediate transfer belt 6 by using at least one of the image forming units 12Y, 12M, and 12C.

The secondary transfer control unit 55 controls the secondary transfer roller 28 of the secondary transfer unit 15.

Because there is no need to transfer toner images in colors Y, M, and C onto the transfer sheet P during black-and-white printing, the secondary transfer control unit 55 separates the secondary transfer roller 28 from the intermediate transfer belt 6. Thus, a toner image in color K formed on the photosensitive element 1K is transferred onto the transfer sheet P at the position of the follower roller 21K by a direct transfer method.

During full-color printing, the secondary transfer control unit 55 controls the secondary transfer roller 28 of the secondary transfer unit 15 so as to locate the secondary transfer roller 28 close to the intermediate transfer belt 6 at a position where images can be transferred onto the transfer sheet P. Thus, the toner images in colors Y, M, and C superimposed on the intermediate transfer belt 6 by an indirect transfer method are transferred onto the transfer sheet P at the position of the secondary transfer roller 28 of the secondary transfer unit 15.

Because there is no need to transfer toner images (the first alignment control pattern 13) in colors Y, M, and C onto the transfer sheet P when the first alignment control process is performed by the first alignment control unit 52*a*, which is explained later, the secondary transfer control unit 55 separates the secondary transfer roller 28 from the intermediate transfer belt 6.

Because there is a need to transfer the second alignment control pattern 14 in color C onto the transfer sheet P when the second alignment control process is performed by the second alignment control unit 52*b*, which is explained later, the secondary transfer control unit 55 operates the secondary transfer roller 28 so that the secondary transfer roller 28 is located close to the intermediate transfer belt 6. Thus, the second alignment control pattern 14 in color C, which has been transferred onto the intermediate transfer belt 6, is transferred onto the transfer sheet P that is in the process of being conveyed by the transfer-sheet conveying belt 8 so that the second alignment control pattern 14 in color C can be superimposed on the second alignment control pattern 14 in color K.

In response to an instruction received by the print control unit 51 to perform the alignment control process, the first alignment control unit 52*a* causes the secondary transfer control unit 55 to perform a separation control and performs the first alignment control process to correct the amount of misalignment (correct main/sub-scanning misregistration, adjust skew, or the like) among images in colors Y, M, and C that have been transferred onto the intermediate transfer belt 6 by the indirect transfer control unit 53. According to the present embodiment, in order to detect the amount of misalignment among the images in different colors, the first alignment control unit 52*a* controls the indirect transfer control unit 53 so as to transfer the first alignment control pattern 13 illustrated in FIG. 6 onto the intermediate transfer belt 6.

Figure 6:
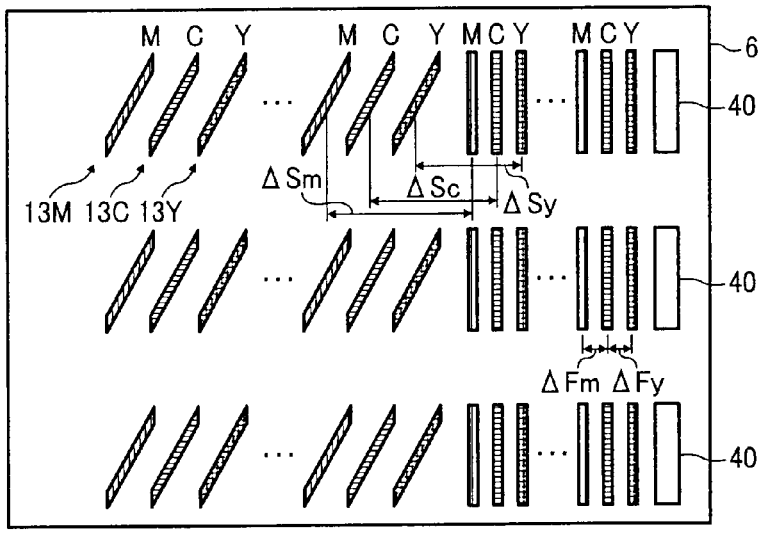
FIG. 6 is a plan view that illustrates an example of a first alignment control pattern according to the first embodiment.

FIG. 6 is a plan view that illustrates an example of the first alignment control pattern 13 (13Y, 13M, 13C). As illustrated in FIG. 6, the first alignment control pattern 13 is formed by arranging three parallel line patterns and three diagonal line patterns at a certain interval in the sub-scanning direction. The first alignment control pattern 13 is repeatedly formed along the conveying direction of the intermediate transfer belt 6. In order to reduce the effect of errors by increasing the number of samples, the first alignment control patterns 13 are output corresponding to the positions of the pattern detection sensors 40, as illustrated in FIG. 6.

Various methods of calculating an amount of misalignment and methods of controlling alignment, which are performed by the first alignment control unit 52*a*, have been heretofore disclosed. An explanation is given of an example of a calculation of an amount of misalignment with reference to FIG. 6. The main-scanning shift amount is calculated by measuring, for each color, the time period (ΔSc, ΔSy, ΔSm) from when the transverse line is detected until when the diagonal line is detected by using a timer of the CPU 101, converting the time period into a length, and comparing the lengths of respective colors with each other. The sub-scanning shift amount is calculated by measuring the time period (ΔFy, ΔFm) after the reference color (here, color C) is detected by using the timer of the CPU 101, converting the time period into a length, and comparing the length with an ideal length. As described above, the shift amount from the ideal distance for each color is obtained, and the shift amount is fed back to the image forming units 12 (12Y, 12M, 12C) for colors Y, M, and C so that misalignment (color deviation) is corrected.

In response to an instruction received by the print control unit 51 to start the second alignment control process, the second alignment control unit 52*b* causes the secondary transfer control unit 55 to perform a contact control so as to transfer, onto the transfer sheet P, the second alignment control pattern 14 in color C, which has been transferred onto the intermediate transfer belt 6 (an image in at least one color, which has been transferred onto the intermediate transfer belt 6) and on which the first alignment control process has been performed, and performs the second alignment control process to correct the misalignment amount of the second alignment control pattern 14 in color K with respect to the second alignment control pattern 14 in color C.

Figure 7:
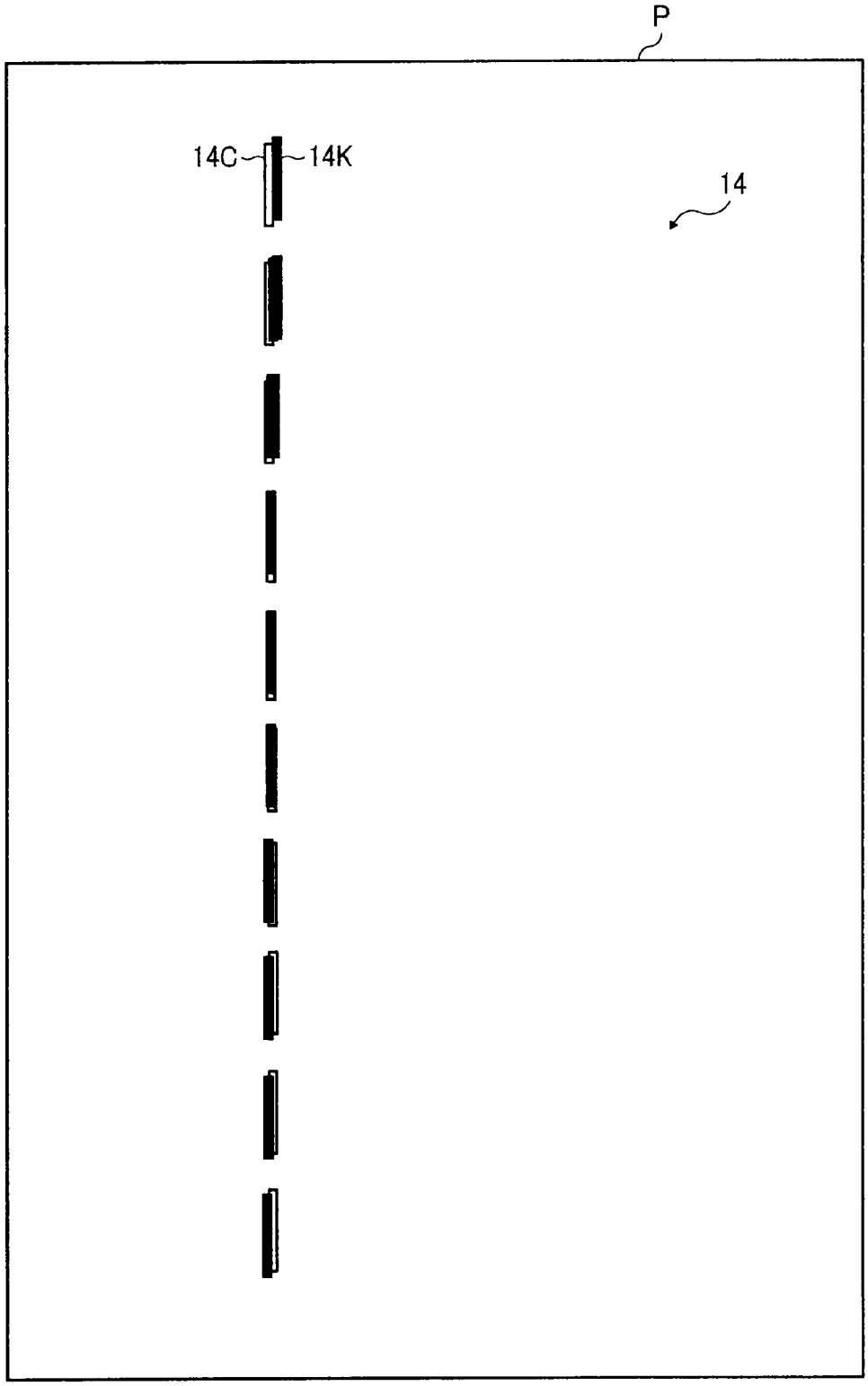
FIG. 7 is a plan view that illustrates an example of a second alignment control pattern according to the first embodiment.

FIG. 7 is a plan view that illustrates an example of the second alignment control pattern 14 transferred onto the transfer sheet P. As illustrated in FIG. 7, the second alignment control pattern 14 in color C is formed by arranging lines (hereinafter, first adjustment patterns 14C) at equal intervals in the sub-scanning direction. The second alignment control pattern 14 in color K is formed by overlapping lines (hereinafter, second adjustment patterns 14K), each having the same shape as that of the first adjustment pattern 14C, on the first adjustment patterns 14C such that the second adjustment pattern 14K is shifted with respect to the first adjustment pattern 14C by an arbitrary amount in at least any one of the main scanning direction and the sub-scanning direction.

A method of calculating an amount of misalignment and a method of controlling alignment, which are performed by the second alignment control unit 52*b*, have been heretofore disclosed (see Japanese Patent No. 3558620). An explanation is given of an example of the calculation of an amount of misalignment with reference to FIG. 7. The amount of misalignment is calculated by using the intensity of a reflected light, which changes in accordance with the degree of overlapping (the amount of misalignment) between the first adjustment pattern 14C and the second adjustment pattern 14K that are overlapped with each other.

Specifically, as for the intensity of the reflected light detected by the pattern detection sensor 50, the intensity of the light diffused by the transfer sheet P that has high reflectivity is the highest, the intensity of the light reflected by the first adjustment pattern 14C is the second highest, the intensity of the light reflected by the first adjustment pattern 14C formed on the second adjustment pattern 14K is the third highest, and the intensity of the light reflected by the second adjustment pattern 14K is the lowest. The correspondence relationship between the intensity of the light reflected by the first adjustment pattern 14C and the second adjustment pattern 14K, which are overlapped with each other, and the degree of overlapping (the amount of misalignment) is stored in a storage unit, such as the HDD 108, in advance, and the amount of misalignment is determined corresponding to the intensity of the reflected light detected by the pattern detection sensor 50, whereby the amount of misalignment is calculated. The amount of misalignment obtained as described above is fed back to the image forming unit 12K for color K so that the amount of misalignment is corrected.

Next, an explanation is given of the control of the entire system performed by the print control unit 51 during full-color printing, black-and-white printing, the first alignment control process, and the second alignment control process with reference to FIGS. 8 to 12.

First, an explanation is given of the control performed by the print control unit 51 during full-color printing. The print control unit 51 controls the indirect transfer control unit 53, the direct transfer control unit 54, the secondary transfer control unit 55, and the like. FIG. 8 is a diagram that illustrates the operations of the photosensitive element 1 and the secondary transfer roller 28 during full-color printing. As illustrated in FIG. 8, during full-color printing, the print control unit 51 causes the photosensitive element 1 (1Y, 1M, 1C) of the image forming unit 12 (12Y, 12M, 12C) to perform a print operation and locates the secondary transfer roller 28 of the secondary transfer unit 15 close to the intermediate transfer belt 6 so that images in all of colors Y, M, C, and K are transferred onto the transfer sheet P during full-color printing. The term "contact" with regard to the secondary transfer roller 28 illustrated in FIG. 8 means that the secondary transfer roller 28 is located close to the intermediate transfer belt 6 so that an image formed on the intermediate transfer belt 6 can be secondarily transferred onto the transfer-sheet conveying belt 8 or the transfer sheet P conveyed by the transfer-sheet conveying belt 8.

Specifically, the print control unit 51 causes an image area of the photosensitive element 1 (1Y, 1M, 1C, 1K), which is uniformly charged by the charging device 2 (2Y, 2M, 2C, 2K), to be irradiated with exposure light for each color emitted by the exposure device 5 and causes the developing device 3 (3Y, 3M, 3C, 3K) to form toner images. Afterwards, the print control unit 51 causes the color toner images formed on the photosensitive elements 1Y, 1M, and 1C to be transferred onto the intermediate transfer belt 6 in synchronized timing, whereby superimposed toner images are formed. The print control unit 51 causes a black toner image formed on the photosensitive element 1K to be directly transferred onto the transfer sheet P conveyed by the transfer-sheet conveying belt 8 that functions as a transfer conveying belt and then causes the Y, M, and C toner images superimposed on the intermediate transfer belt 6 to be transferred onto the transfer sheet P. Thus, the transfer-sheet conveying belt 8 functions as a direct transfer belt in a transfer section for black toner images and functions as a secondary transfer belt in a transfer section for Y, M, and C toner images on the intermediate transfer belt 6.

Afterwards, the print control unit 51 causes the fixing device 10 to fix the toner images to the transfer sheet P, onto which the black toner image and the Y, M, and C toner images have been transferred in a superimposed manner, and then completes the print process for a full-color image. The print control unit 51 causes the transfer sheet P, for which fixing is complete, to be conveyed on a conveying path R1 (see FIG. 1) and causes a discharge roller pair 30 to discharge the transfer sheet P into a discharge tray 31 with the printed side face down, whereby the transfer sheet P is stacked. For a two-sided mode, the print control unit 51 causes the transfer sheet P to be guided to a conveying path R2 by using an undepicted switch claw, turned over by a duplex unit 34, and then conveyed to the registration roller pair 24 so that the transfer sheet P is delivered to a discharge path in the same manner as for a one-sided copy.

Next, an explanation is given of the control performed by the print control unit 51 during black-and-white printing. During black-and-white printing, the print control unit 51 controls the direct transfer control unit 54, the secondary transfer control unit 55, and the like. FIG. 9 is a diagram that illustrates the operations of the photosensitive element 1 and the secondary transfer roller 28 during black-and-white printing. As illustrated in FIG. 9, during black-and-white printing, the print control unit 51 causes only the photosensitive element 1K of the image forming unit 12K to perform a print operation so that an image only in color K is transferred onto the transfer sheet P during black-and-white printing. Further, during black-and-white printing, the print control unit 51 separates the secondary transfer roller 28 of the secondary transfer unit 15 from the intermediate transfer belt 6. The term "separation" with regard to the secondary transfer roller 28 illustrated in FIG. 9 means that the secondary transfer roller 28 is located away from the intermediate transfer belt 6.

Specifically, the print control unit 51 causes an image area of the photosensitive element 1K to be irradiated with light from the exposure device 5 by using black image data and then causes the developing device 3K to form a toner image. The print control unit 51 causes the formed black toner image to be directly transferred onto the transfer sheet P conveyed by the transfer-sheet conveying belt 8 and the print control unit 51 causes the fixing device 10 to fix the image, thereby forming a monochrome image. During printing of a monochrome image, the contact areas of the intermediate transfer belt 6 and the transfer-sheet conveying belt 8 are separated from each other as illustrated in FIG. 2, and the image forming units 12 (12Y, 12M, 12C) for colors Y, M, and C and the intermediate transfer belt 6 are not operated. Thus, an advantage is produced such that longer operating lives of the image forming units 12 (12Y, 12M, 12C) for colors Y, M, and C and the intermediate transfer belt 6 can be achieved.

Next, an explanation is given of the control performed by the print control unit 51 during the first alignment control process. During the first alignment control process, the print control unit 51 controls the first alignment control unit 52*a*, the indirect transfer control unit 53, the secondary transfer control unit 55, and the like. FIG. 10 is a diagram that illustrates the operations of the photosensitive element 1 and the secondary transfer roller 28 during the first alignment control process. As illustrated in FIG. 10, during the first alignment control process, the print control unit 51 operates the photosensitive elements 1Y, 1M, and 1C so as to form the first alignment control patterns 13Y, 13M, and 13C (see FIG. 6) in colors Y, M, and C on the intermediate transfer belt 6. At that time, under the control of the first alignment control unit 52*a*, the print control unit 51 causes the secondary transfer control unit 55 to separate the secondary transfer roller 28 and the intermediate transfer belt 6 from each other and causes the direct transfer control unit 54 to stop the operation of the photosensitive element 1K.

Next, an explanation is given of the control performed by the print control unit 51 during the second alignment control. During the second alignment control process, the print control unit 51 controls the second alignment control unit 52*b*, the indirect transfer control unit 53, the direct transfer control unit 54, the secondary transfer control unit 55, and the like. FIG. 11 is a diagram that illustrates the operations of the photosensitive element 1 and the secondary transfer roller 28 during the second alignment control process. As illustrated in FIG. 11, during the second alignment control process, the print control unit 51 operates the photosensitive element 10 so as to form the second alignment control pattern 14 in color C (see FIG. 7) on the intermediate transfer belt 6 and operates the photosensitive element 1K so as to form the second alignment control pattern 14 in color K (see FIG. 7) on the transfer-sheet conveying belt 8. Further, during the second alignment control process, the print control unit 51 brings the secondary transfer roller 28 into contact with the intermediate transfer belt 6 so that the second alignment control pattern 14 in color C formed on the intermediate transfer belt 6 is transferred onto the transfer sheet P. At that time, the photosensitive elements 1M and 1Y, which are not used for the second alignment control process, are run idle.

Next, an explanation is given of the control performed by the print control unit 51 if the first alignment control process is performed at the same time as black-and-white printing. FIG. 12 is a diagram that illustrates the operations of the photosensitive element 1 and the secondary transfer roller 28 if the first alignment control process is performed at the same time as black-and-white printing. As illustrated in FIG. 12, the print control unit 51 causes the secondary transfer roller 28 of the secondary transfer unit 15 to be separated from the intermediate transfer belt 6 and causes only the photosensitive element 1K to perform a print operation so that an image only in color K is transferred onto the transfer sheet P. Further, the print control unit 51 operates the photosensitive elements 1Y, 1M, and 1C so as to form the first alignment control patterns 13Y, 13M, and 13C (see FIG. 6) in colors Y, M, and C on the intermediate transfer belt 6. The print control unit 51 then causes the first alignment control unit 52*a* to perform the first alignment control process. Thus, the print control unit 51 can allow the print operation of the image forming unit 12K for color K during black-and-white printing to be performed at the same time as the first alignment control process, i.e., the first alignment control process for the images formed by the image forming units 12 (12Y, 12M, 12C) for colors Y, M, and C, whereby the first alignment control process can be performed without increasing printing downtime. Moreover, the contact areas of the intermediate transfer belt 6 and the transfer-sheet conveying belt 8 are separated from each other so that it is possible to prevent adherence of the first alignment control patterns 13Y, 13M, and 13C to the transfer-sheet conveying belt 8 and adherence of toner in colors Y, M, and C to the back surface of the transfer sheet P, on which black-and-white printing is concurrently performed, thereby preventing contamination of the back surface.

Figure 13:
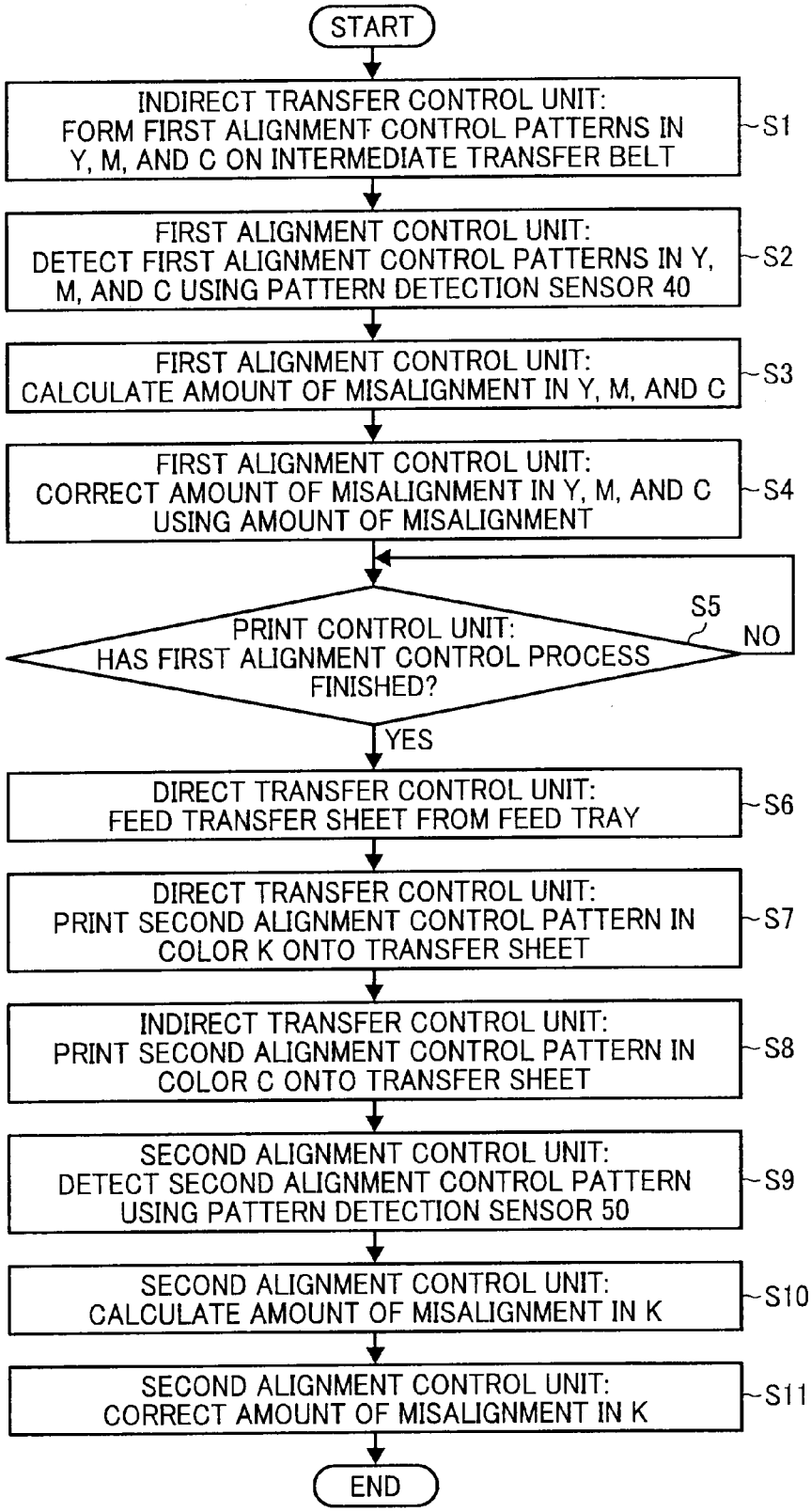
FIG. 13 is a flowchart that illustrates the procedures of the first alignment control process and the second alignment control process according to the first embodiment.

An explanation is given of the procedure of the first alignment control process and the second alignment control process performed by the MFP 100 according to the first embodiment with reference to FIG. 13.

FIG. 13 is a flowchart that illustrates the procedures of the first alignment control process and the second alignment control process performed by the MFP 100 according to the first embodiment. The process illustrated in Steps S1 to S5 is the first alignment control process, and the process illustrated in Step S6 to S11 is the second alignment control process.

If an instruction to start the alignment control process is given by the user via the operation input unit 400 or a predetermined time elapses, the print control unit 51 instructs the first alignment control unit 52*a*, the indirect transfer control unit 53, and the secondary transfer control unit 55 to start the first alignment control process.

The indirect transfer control unit 53 controls the image forming units 12Y, 12M, and 12C and the intermediate transfer belt 6 so as to form the first alignment control patterns 13Y, 13M, and 13C (see FIG. 6) on the intermediate transfer belt 6 (Step S1). At that time, the first alignment control unit 52*a* causes the secondary transfer control unit 55 to separate the secondary transfer roller 28 and the intermediate transfer belt 6 from each other. The first alignment control unit 52*a* then causes the pattern detection sensors 40 to detect the first alignment control patterns 13Y, 13M, and 13C formed on the intermediate transfer belt 6 by the image forming units 12Y, 12M, and 12C (Step S2), thereby calculating the amount of misalignment (Step S3). By using the amount of misalignment, the first alignment control unit 52*a* corrects the amount of misalignment among the images formed by the image forming units 12Y, 12M, and 12C (Step S4). While the first alignment control process is performed at Steps S1 to S4, the print control unit 51 determines whether the first alignment control process has finished (Step S5) and, if it is determined that the first alignment control process has not finished yet (Step S5: No), returns to Step S5 to stand by until the first alignment control process has finished.

Conversely, if it is determined that the first alignment control process has finished (Step S5: Yes), the print control unit 51 instructs the second alignment control unit 52*b*, the indirect transfer control unit 53, the direct transfer control unit 54, and the secondary transfer control unit 55 to start the second alignment control process. The direct transfer control unit 54 controls the transfer-sheet conveying belt 8, and the like, so as to feed the transfer sheet P from the feed tray 22 or 23 (Step S6). Then, the direct transfer control unit 54 controls the image forming unit 12K and the transfer-sheet conveying belt 8 so as to form the toner image of the second alignment control pattern 14 in color K (the plurality of second adjustment patterns 14K) on the photosensitive element 1K and transfers the toner image onto the transfer sheet P, which is in the process of being conveyed, by a direct transfer method at the point where the photosensitive element 1K is in contact with the follower roller 21K that is a transfer unit (Step S7).

The indirect transfer control unit 53 then controls the image forming unit 12C and the intermediate transfer belt 6 so as to form the second alignment control pattern 14 in color C (the plurality of first adjustment patterns 14C) on the intermediate transfer belt 6. The second alignment control unit 52*b* controls the secondary transfer control unit 55 so as to locate the secondary transfer roller 28 close to the intermediate transfer belt 6 and secondarily transfer the second alignment control pattern 14 in color C formed on the intermediate transfer belt 6 onto the transfer sheet P that is in the process of being conveyed by the transfer-sheet conveying belt 8 (Step S8). Thus, the first adjustment patterns 14C and the second adjustment patterns 14K are superimposed on the transfer sheet P.

The second alignment control unit 52*b* then causes the pattern detection sensor 50 to detect the second alignment control pattern 14 (a plurality of pairs of first adjustment patterns 14C and second adjustment patterns 14K) formed on the transfer sheet P (Step S9). The second alignment control unit 52*b* then calculates, for each of the pairs, the amount of misalignment of the second adjustment pattern in color K with respect to the first adjustment pattern in color C (Step S10). The second alignment control unit 52*b* corrects the amount of misalignment of the second adjustment pattern 14K in color K, for which the amount of misalignment with respect to the first adjustment pattern 14C in color C is the smallest, thereby performing the second alignment control process (Step S11).

According to the first embodiment, after the amount of misalignment is corrected at Step S11, the transfer sheet P used for the second alignment control process is discharged to the discharge tray 31 illustrated in FIG. 1. The transfer sheet P may be automatically collected by being discharged into, not the discharge tray 31, but a purge tray (not illustrated) located near the feed trays 22 and 23.

In the MFP 100 according to the first embodiment, an image in color K, which has been directly transferred onto the transfer sheet P by a direct transfer method, and an image in at least one of colors Y, M, and C, which has been transferred onto the transfer sheet P by an indirect transfer method and on which the first alignment control process has been performed, are superimposed on the transfer sheet P, and the amount of misalignment of the directly transferred image in color K with respect to the color image on which the first alignment control process has been performed is corrected, whereby it is possible to perform the alignment control of the image formed by the indirect transfer method and the image formed by the direct transfer method by using the images transferred onto one transfer target (the transfer sheet P) and whereby it is possible to accurately correct the amount of misalignment by detecting the amount of misalignment occurring on the actual print image; therefore, it is possible to perform the alignment control of the image transferred by the indirect transfer method and the alignment control of the image transferred by the direct transfer method in an image forming apparatus that uses, in combination, the indirect transfer method and the direct transfer method in a simple and accurate manner.

According to a second embodiment, the amount of misalignment is corrected using one pair of the first adjustment pattern 14C and the second adjustment pattern 14K that is selected by the user from a plurality of pairs of the first adjustment patterns 14C and the second adjustment patterns 14K.

Figure 14:
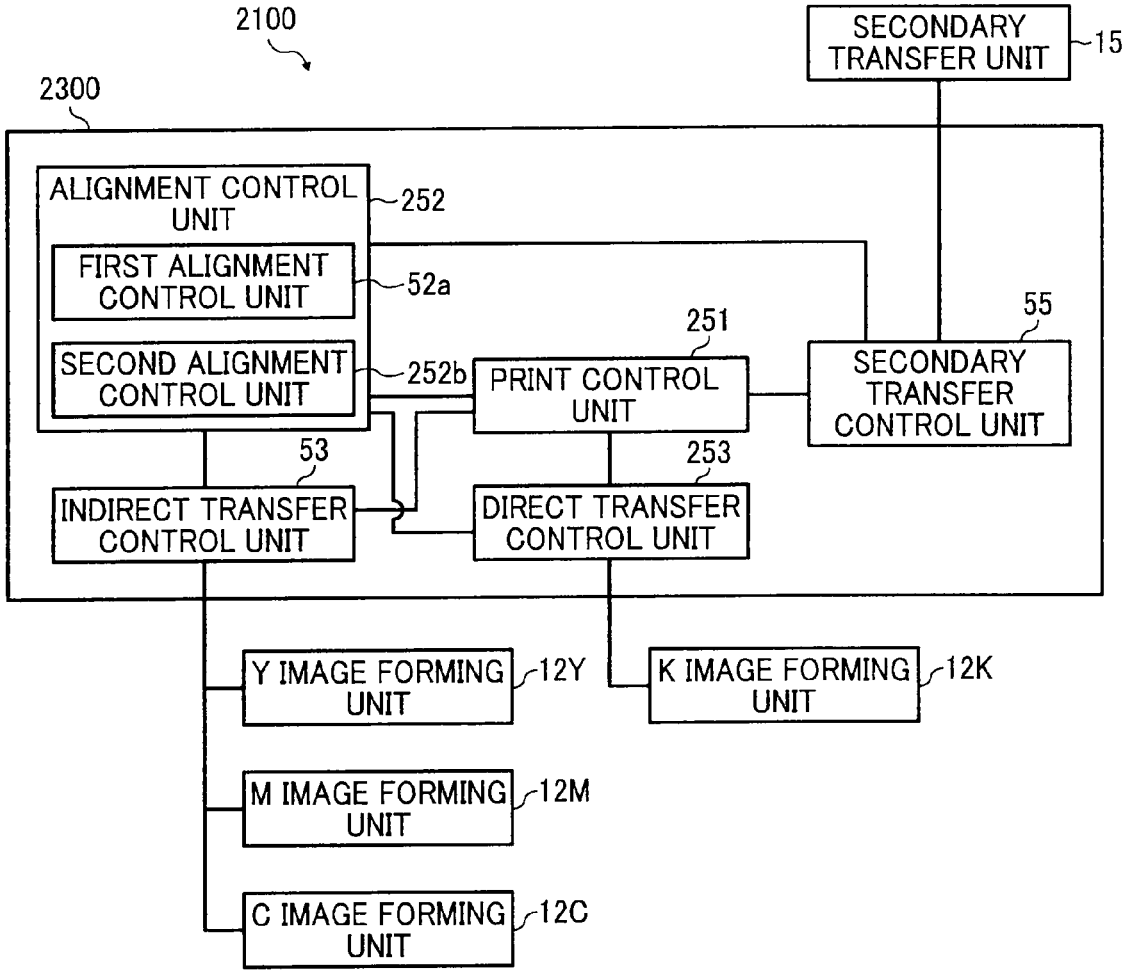
FIG. 14 is a block diagram that illustrates the functional configuration of a printer unit of a Multi Function Peripheral according to a second embodiment.

FIG. 14 is a block diagram that illustrates the functional configuration of a printer unit 2300 of an MFP 2100 according to the second embodiment. Because the indirect transfer control unit 53 and the secondary transfer control unit 55 have the same functions as those in the first embodiment, their explanations are not repeated here. An alignment control unit 252 includes the first alignment control unit 52*a* and a second alignment control unit 252*b* that has a different functional configuration from that of the second alignment control unit 52*b* in the first embodiment. Because the first alignment control unit 52*a* has the same function as that in the first embodiment, its explanation is not repeated here.

Figure 15:
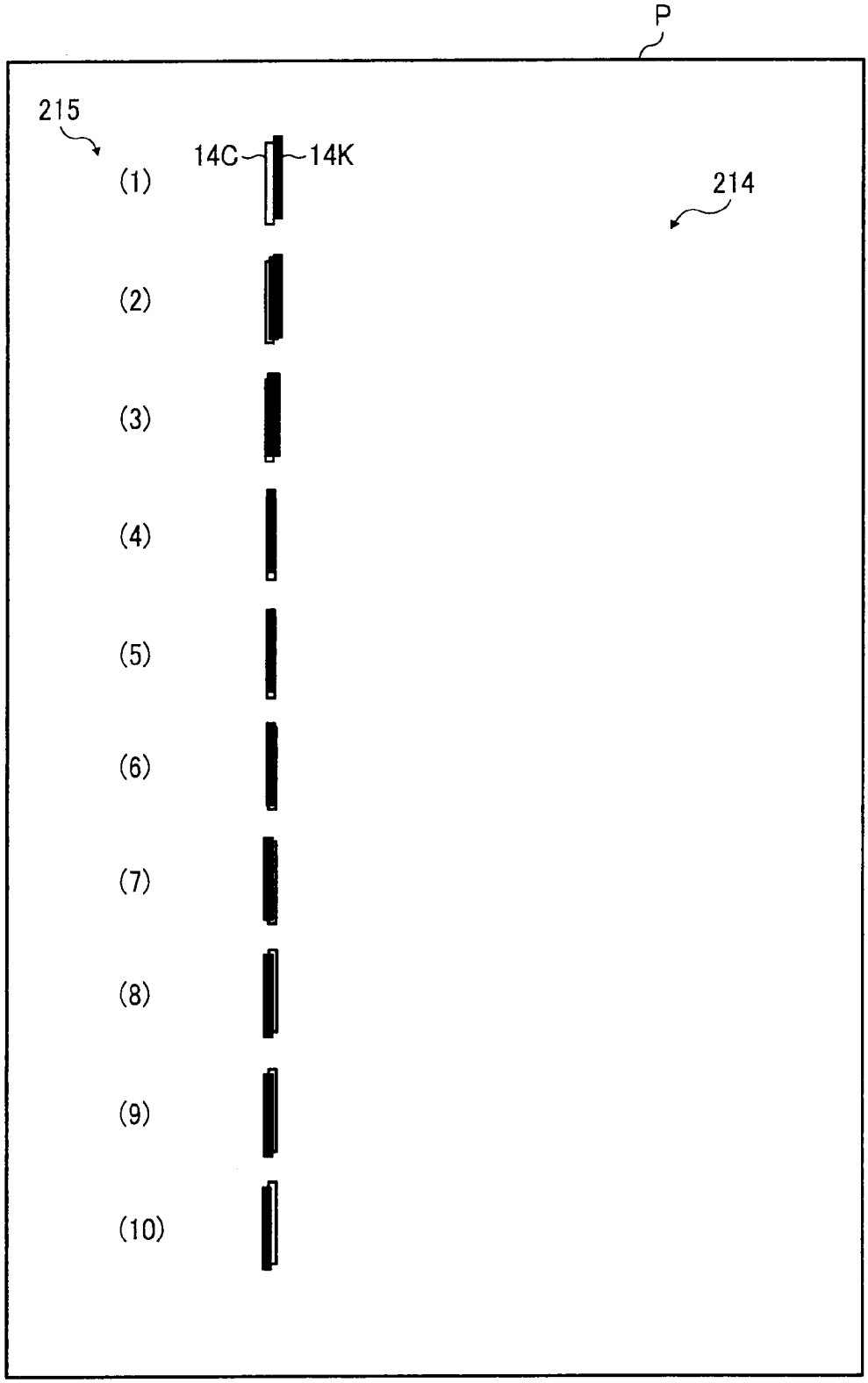
FIG. 15 is a plan view that illustrates an example of the second alignment control pattern according to the second embodiment.

FIG. 15 is a plan view that illustrates an example of the second alignment control pattern. As illustrated in FIG. 15, a direct transfer control unit 253 controls the image forming unit 12K and the transfer-sheet conveying belt 8 so as to transfer, onto the transfer sheet P, a second alignment control pattern 214 in color K that includes, in addition to a plurality of second adjustment patterns 14K, identification information 215 (for example, a number, or the like) that is assigned to each of the pairs of the first adjustment patterns 14C and the second adjustment patterns 14K. Thus, the user selects the identification information 215 so as to select the desired pair of the first adjustment pattern 14C and the second adjustment pattern 14K (the figure illustrating the degree of misalignment).

A print control unit (a receiving unit) 251 receives one selected pair of the first adjustment pattern 14C and the second adjustment pattern 14K, to which the identification information 215 input via the operation input unit 400 is assigned, from the plurality of pairs of the first adjustment patterns 14C and the second adjustment patterns 14K.

The second alignment control unit 252*b* corrects the amount of misalignment of the second adjustment pattern 14K with respect to the first adjustment pattern 14C in the selected pair, which is received by the print control unit 251, among the pairs of the first adjustment patterns 14C and the second adjustment patterns 14K that are overlapped with each other, thereby performing the second alignment control process.

The second alignment control unit 252*b* may store the amount of misalignment used for the second alignment control process in the RAM 302 (the storage unit) and correct the amount of misalignment stored in the RAM 302 in subsequent second alignment control processes. Thus, there is no need to print the second alignment control pattern 214 onto the transfer sheet P, detect the second alignment control pattern 214, calculate the amount of misalignment, and the like, every time the second alignment control process is performed, whereby it is possible to shorten the time required for subsequent second alignment control processes and improve convenience for users.

The print control unit 251 (the receiving unit) may receive, via the operation input unit 400, an instruction as to whether the amount of misalignment stored in the RAM 302 is to be used in subsequent second alignment control processes. Thus, it is possible to select whether the whole second alignment control process is performed every time so that priority is placed on the improvement of image quality or the amount of misalignment stored in the RAM 302 is corrected as described above so that the time required for the second alignment control process is shortened, whereby the accuracy of the second alignment control process can be set in accordance with the purpose.

Figures 16, 16A, 16B:
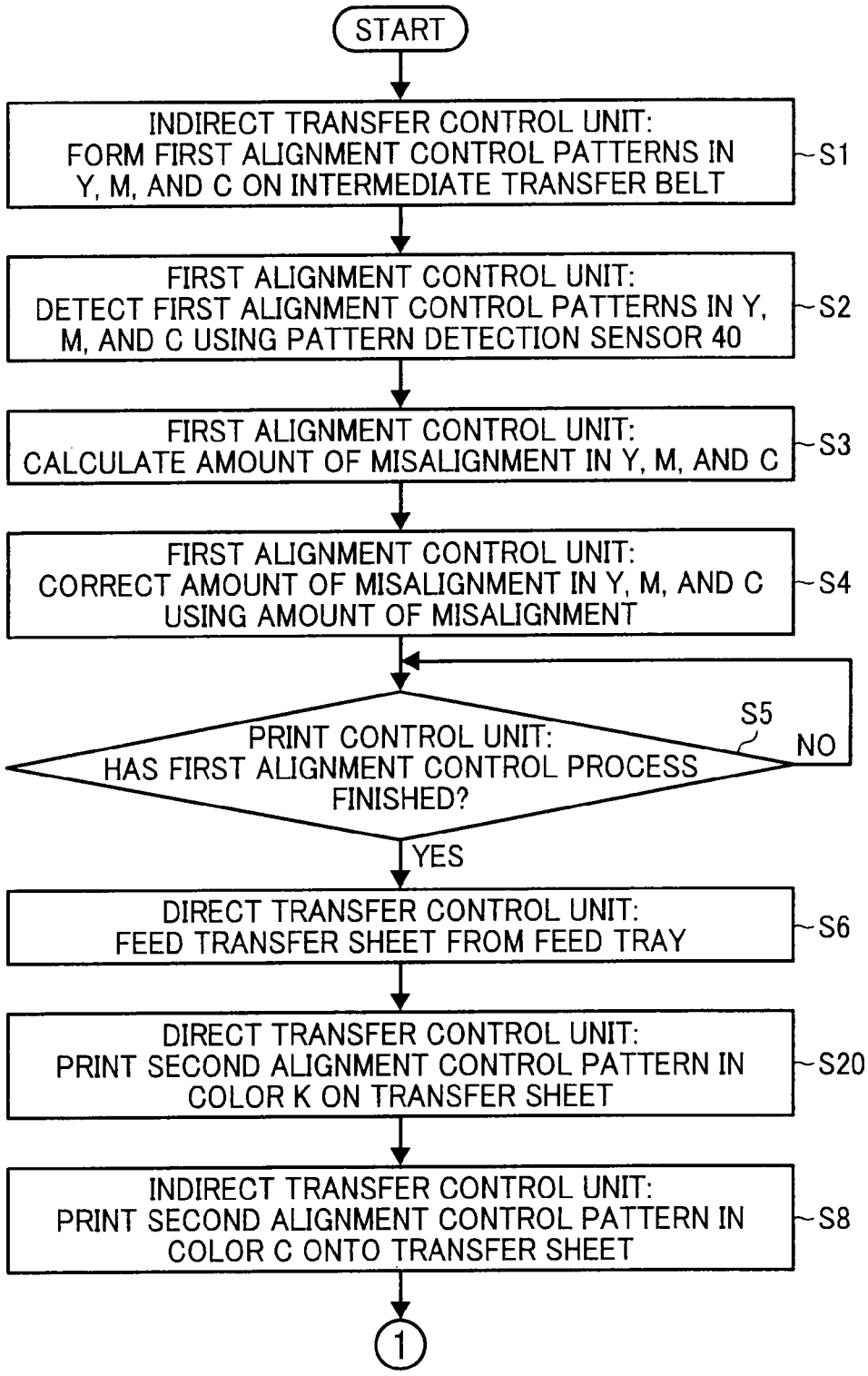
FIG. 16 is a flowchart that illustrates the procedures of the first alignment control process and the second alignment control process according to the second embodiment.
Figure 16B:
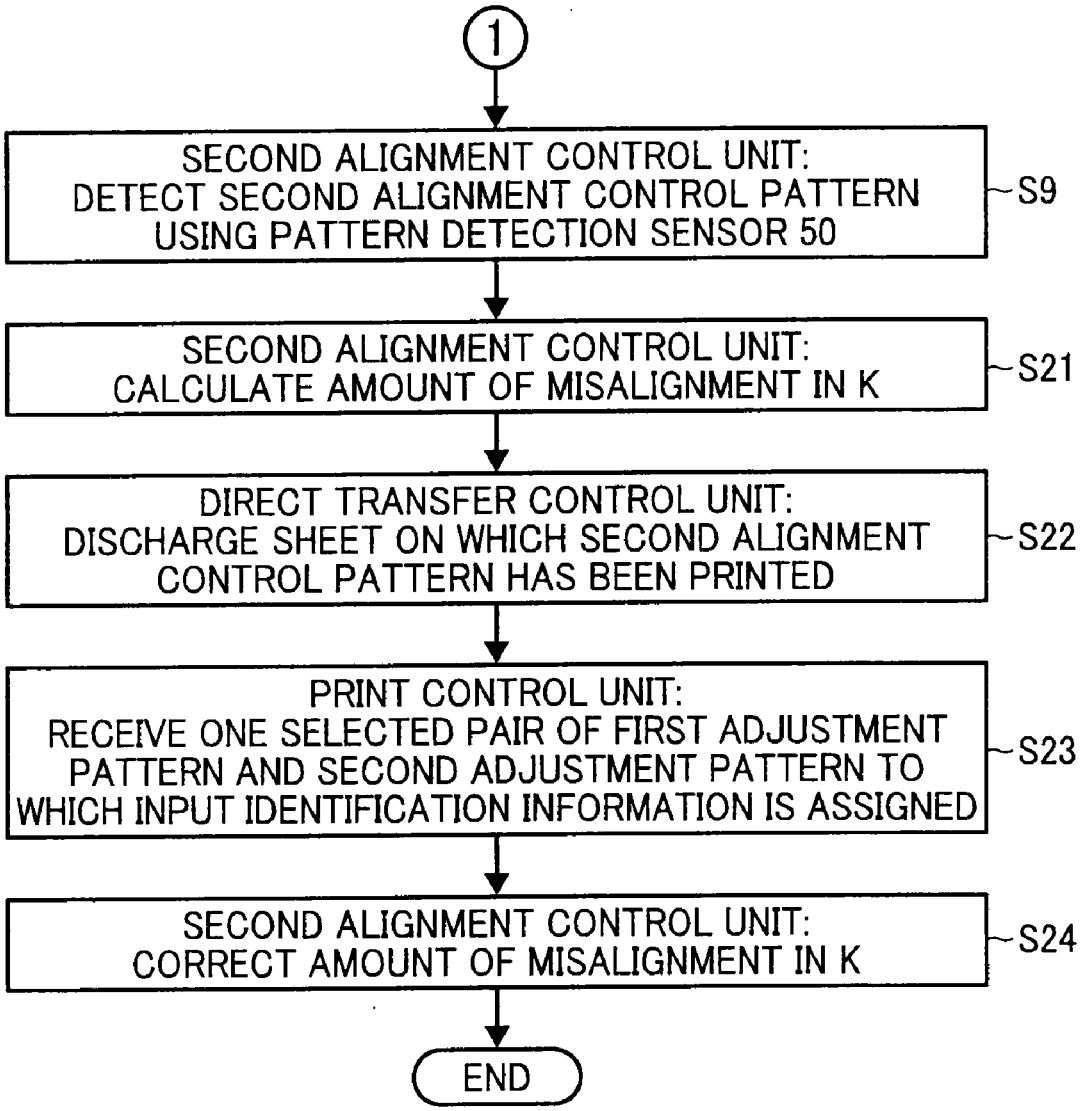

Next, an explanation is given of the procedures of the first alignment control process and the second alignment control process performed by the MFP 2100 according to the second embodiment with reference to FIG. 16. FIG. 16 is a flowchart that illustrates the procedures of the first alignment control process and the second alignment control process performed by the MFP 2100 according to the second embodiment.

Because the process from Steps S1 to S6 and S8 to S9 is the same as the process performed by the MFP 100 according to the first embodiment, its explanation is not repeated here.

The direct transfer control unit 253 forms, on the photosensitive element 1K, the toner image of the second alignment control pattern 214 in color K, which includes the plurality of second adjustment patterns 14K and the identification information 215, and transfers the toner image onto the transfer sheet P, which is in the process of being conveyed, by a direct transfer method at the point where the photosensitive element 1K and the follower roller 21K, which is a transfer unit, are in contact with each other (Step S20). The second alignment control unit 252*b* then calculates, for each of the pairs, the amount of misalignment of the second adjustment pattern 14K in color K with respect to the first adjustment pattern 14C in color C and stores the identification number of each of the pairs and the amount of misalignment of each of the pairs in the RAM 302 such that they are linked to each other (Step S21). The direct transfer control unit 253 then discharges the transfer sheet P, on which the second alignment control pattern 214 has been printed, to the discharge tray 31 (Step S22).

The print control unit 251 receives one selected pair of the first adjustment pattern 14C and the second adjustment pattern 14K to which the identification information 215 input via the operation input unit 400 is assigned (Step S23). The second alignment control unit 252*b* corrects the amount of misalignment of the second adjustment pattern 14K with respect to the first adjustment pattern 14C in the selected pair, which is received by the print control unit 251, among the amounts of misalignment calculated at Step S21, thereby performing the second alignment control process (Step S24).

In the MFP 2100 according to the second embodiment, the amount of misalignment is corrected using one pair of the first adjustment pattern 14C and the second adjustment pattern 14K that is selected by the user from a plurality of pairs of the first adjustment patterns 14C and the second adjustment patterns 14K so that the alignment control can be performed at a print quality desired by the user, whereby the convenience of the MFP 2100 can be improved.

Although the MFPs 100 and 2100 include the image forming unit 12K for black as an image forming unit that uses a direct transfer method in the above description, the present invention is not limited thereto, and the MFPs 100 and 2100 may include an image forming unit for a different color. Further, the MFPs 100 and 2100 may include a plurality of image forming units, such as an image forming unit for black and an image forming unit for red, as image forming units that use the direct transfer method.

According to an aspect of the present invention, it is possible to perform the alignment control of the image formed by an indirect transfer method and the image formed by a direct transfer method by using the images transferred onto one transfer target and it is possible to accurately correct the amount of misalignment by detecting the amount of misalignment occurring on the actual print image; therefore, an advantage is produced such that it is possible to perform the alignment control of the image transferred by the indirect transfer method and the alignment control of the image transferred by the direct transfer method in an image forming apparatus that uses, in combination, the indirect transfer method and the direct transfer method in a simple and accurate manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a direct transfer control unit that controls a first image forming unit that forms an image in a single color or a plurality of colors and controls a direct transfer unit so as to directly transfer the image in the single color or the plurality of colors onto a transfer sheet that is conveyed by the direct transfer unit;

an indirect transfer control unit that controls a second image forming unit that forms images in a plurality of colors except for the color of the image formed by the first image forming unit and controls an intermediate transfer unit so as to transfer the images in the plurality of colors onto the intermediate transfer unit;

a secondary transfer control unit that controls contact and separation between the direct transfer unit and the intermediate transfer unit;

a first alignment control unit that causes the secondary transfer control unit to perform a separation control and corrects an amount of misalignment among the images in the plurality of colors formed on the intermediate transfer unit, thereby performing a first alignment control process; and a second alignment control unit that causes the secondary transfer control unit to perform a contact control, transfers, onto the transfer sheet, an image in at least one color formed on the intermediate transfer unit, the first alignment control process having been performed on the image, and corrects an amount of misalignment of an image that is directly transferred onto the transfer sheet with respect to the image on which the first alignment control process has been performed, thereby performing a second alignment control process.

2. The image forming apparatus according to claim 1, wherein the indirect transfer control unit controls the second image forming unit and the intermediate transfer unit so as to transfer first adjustment patterns at equal intervals as the image on which the first alignment control process has been performed, the direct transfer control unit controls the first image forming unit and the direct transfer unit so as to directly transfer, onto the transfer sheet, second adjustment patterns as the image in the single color or the plurality of colors, the second adjustment patterns being overlapped with the respective first adjustment patterns and shifted with respect to the first adjustment patterns by a predetermined amount, and the second alignment control unit corrects an amount of misalignment of the second adjustment pattern with respect to the first adjustment pattern in one pair among a plurality of pairs of the first adjustment patterns and the second adjustment patterns.

3. The image forming apparatus according to claim 2, further comprising a receiving unit that receives one selected pair of the first adjustment pattern and the second adjustment pattern from the plurality of pairs of the first adjustment patterns and the second adjustment patterns, wherein the second alignment control unit corrects an amount of misalignment of the second adjustment pattern with respect to the first adjustment pattern in one selected pair received by the receiving unit.

4. The image forming apparatus according to claim 3, further comprising a storage unit that stores therein the amount of misalignment that is used for the second alignment control process, wherein the second alignment control unit corrects the amount of misalignment stored in the storage unit in subsequent second alignment control processes.

5. The image forming apparatus according to claim 1, wherein the first alignment control unit performs the first alignment control process if images in a plurality of colors are not being transferred onto the intermediate transfer unit by the second image forming unit.

6. The image forming apparatus according to claim 1, further comprising a print control unit that gives an instruction to start the second alignment control process if it is determined that the first alignment control process is finished, wherein the second alignment control unit performs the second alignment control process if the print control unit gives an instruction to start the second alignment control process.

7. The image forming apparatus according to claim 4, further comprising a receiving unit that receives an instruction as to whether the amount of misalignment stored in the storage unit is to be used in the subsequent second alignment control processes, wherein the second alignment control unit corrects the amount of misalignment stored in the storage unit in the subsequent second alignment control processes if the receiving unit receives an instruction to use the amount of misalignment.

8. The image forming apparatus according to claim 1, wherein the first image forming unit forms a black image.

9. An image forming method performed by an image forming apparatus including a control unit and a storage unit, the image forming method comprising:

causing, by the control unit, a direct transfer control unit to control a first image forming unit that forms an image in a single color or a plurality of colors and to control a direct transfer unit so as to directly transfer the image in the single color or the plurality of colors onto a transfer sheet that is conveyed by the direct transfer unit;

causing, by the control unit, an indirect transfer control unit to control a second image forming unit that forms images in a plurality of colors except for the color of the image formed by the first image forming unit and to control an intermediate transfer unit so as to transfer the images in the plurality of colors onto the intermediate transfer unit;

causing, by the control unit, a secondary transfer control unit to control contact and separation between the direct transfer unit and the intermediate transfer unit;

causing, by the control unit, a first alignment control unit to cause the secondary transfer control unit to perform a separation control and to detect an amount of misalignment among the images in the plurality of colors formed on the intermediate transfer unit so as to correct the amount of misalignment, thereby performing a first alignment control process; and causing, by the control unit, a second alignment control unit to cause the secondary transfer control unit to perform a contact control, and to transfer, onto the transfer sheet, an image in at least one color formed on the intermediate transfer unit, the first alignment control process having been performed on the image, and correct an amount of misalignment of an image that is directly transferred onto the transfer sheet with respect to a position of the image on which the first alignment control process has been performed, thereby performing a second alignment control process.

10. A computer program product comprising a non-transitory computer-readable medium having computer-readable program codes embodied in the medium, when executed by a computer, the program codes causing the computer to perform:

controlling a first image forming unit that forms an image in a single color or a plurality of colors and controlling a direct transfer unit so as to directly transfer the image in the single color or the plurality of colors onto a transfer sheet that is conveyed by the direct transfer unit;

controlling a second image forming unit that forms images in a plurality of colors except for the color of the image formed by the first image forming unit and controlling an intermediate transfer unit so as to transfer the images in the plurality of colors onto the intermediate transfer unit;

controlling contact and separation between the direct transfer unit and the intermediate transfer unit;

controlling to separate the direct transfer unit and the intermediate transfer unit, and detecting and correcting an amount of misalignment among the images in the plurality of colors formed on the intermediate transfer unit, thereby performing a first alignment control process; and controlling to contact the direct transfer unit with the intermediate transfer unit, transferring, onto the transfer sheet, an image in at least one color formed on the intermediate transfer unit, the first alignment control process having been performed on the image, and correcting an amount of misalignment of an image that is directly transferred onto the transfer sheet with respect to the image on which the first alignment control process has been performed, thereby performing a second alignment control process.

* * * * *